US011811174B2

(12) United States Patent
Amini et al.

(10) Patent No.: US 11,811,174 B2
(45) Date of Patent: Nov. 7, 2023

(54) LOW-PROFILE AXISYMMETRIC POWER CONNECTORS

(71) Applicant: Apple Inc., Cupertino, CA (US)

(72) Inventors: Mahmoud R. Amini, Sunnyvale, CA (US); Rui Zhou, Sunnyvale, CA (US); James E. Harper, Paso Robles, CA (US); James M. Jeon, Mountain House, CA (US)

(73) Assignee: Apple Inc., Cupertino, CA (US)

( * ) Notice: Subject to any disclaimer, the term of this patent is extended or adjusted under 35 U.S.C. 154(b) by 74 days.

(21) Appl. No.: 17/232,712

(22) Filed: Apr. 16, 2021

(65) Prior Publication Data

US 2022/0102923 A1 Mar. 31, 2022

Related U.S. Application Data

(60) Provisional application No. 63/083,850, filed on Sep. 25, 2020.

(51) Int. Cl.
*H01R 24/38* (2011.01)
*H01R 13/62* (2006.01)
(Continued)

(52) U.S. Cl.
CPC ..... *H01R 24/38* (2013.01); *H01R 13/6205* (2013.01); *H01R 13/6277* (2013.01);
(Continued)

(58) Field of Classification Search
CPC .... H01R 24/00; H01R 24/38; H01R 13/6277; H01R 13/03; H01R 13/642; H01R 13/6581
See application file for complete search history.

(56) References Cited

U.S. PATENT DOCUMENTS 2,404,564 A 7/1946 Boehlke
2,519,933 A 8/1950 Rouault
(Continued)

FOREIGN PATENT DOCUMENTS

TW 1318025 12/2009

OTHER PUBLICATIONS

"Presto 9984 Control Master Heat Control with Magnetic Cord," obtained from http://www.cookingandcanning.net/pr99comaheco.html, generated Jan. 18, 2006, 1-pg.
(Continued)

*Primary Examiner* — Thanh Tam T Le
(74) *Attorney, Agent, or Firm* — KILPATRICK TOWNSEND & STOCKTON, LLP

(57) ABSTRACT

Power connectors that are easy to connect, have a low profile, and can convey one or more data signals. One example can provide a power connector that is easy to connect by providing an axisymmetric connector receptacle and connector insert. Magnets can be used to help guide a connection between a connector insert and a connector receptacle. Canted springs can be used to provide a tactile response to the insertion of the connector insert into the connector receptacle and to help to secure the connector insert in place when mated with the connector insert. Keying or self-aligning features can be included on either or both the connector insert and the connector receptacle to help guide mating.

20 Claims, 38 Drawing Sheets

(51) Int. Cl.

| | |
|---|---|
| ***H01R 13/627*** | (2006.01) |
| *H01R 13/6581* | (2011.01) |
| *H01R 13/03* | (2006.01) |
| *H01R 13/642* | (2006.01) |

(52) U.S. Cl.
CPC ..... *H01R 13/03* (2013.01); *H01R 13/642* (2013.01); *H01R 13/6581* (2013.01)

(56) References Cited

U.S. PATENT DOCUMENTS

| | | | | |
|---|---|---|---|---|
| 4,025,964 | A | 5/1977 | Owens | |
| 4,947,846 | A | 8/1990 | Kitagawa | |
| 4,978,306 | A | 12/1990 | Robb | |
| 5,606,237 | A | 2/1997 | Biasotti et al. | |
| 2,117,967 | A | 5/1998 | Albin | |
| 5,980,290 | A | 11/1999 | Meynier | |
| 6,267,602 | B1 | 7/2001 | Mendelson | |
| 6,848,937 | B1 | 2/2005 | Hsiao et al. | |
| 6,866,527 | B2 * | 3/2005 | Potega | H01R 24/58 439/668 |
| 6,976,878 | B2 | 12/2005 | Shindo | |
| 7,175,441 | B2 | 2/2007 | Naviaux | |
| 7,311,526 | B2 | 12/2007 | Rohrbach et al. | |
| 7,625,213 | B1 | 12/2009 | Tse | |
| 7,722,259 | B2 * | 5/2010 | Smith, III | H01R 13/502 439/98 |
| 8,450,610 | B2 * | 5/2013 | Alvelo | H01B 7/18 439/98 |
| 8,469,730 | B2 | 6/2013 | Garb | |
| 8,491,332 | B1 | 7/2013 | Mo | |
| 8,888,500 | B2 | 11/2014 | Gao et al. | |
| 8,979,549 | B2 | 3/2015 | Lin | |
| 9,065,205 | B2 | 6/2015 | Gao et al. | |
| 10,276,950 | B1 * | 4/2019 | Amini | H01R 13/658 |
| 10,344,402 | B2 | 7/2019 | Degner | |
| 10,431,944 | B1 * | 10/2019 | Su | H01R 24/86 |
| 11,165,196 | B2 * | 11/2021 | Yonnet | H01R 13/631 |
| 11,374,367 | B2 * | 6/2022 | Johnson | H01R 13/641 |
| 11,381,033 | B2 * | 7/2022 | Johnson | H01R 13/64 |
| 11,450,999 | B2 | 9/2022 | Soohoo et al. | |
| 2008/0261430 | A1 | 10/2008 | Wadsworth | |
| 2009/0154883 | A1 | 6/2009 | Robb | |
| 2011/0081788 | A1 | 4/2011 | Robb | |
| 2013/0244493 | A1 | 9/2013 | Powley | |
| 2014/0065845 | A1 | 3/2014 | Ando | |
| 2014/0273546 | A1 | 9/2014 | Harmon | |
| 2016/0127643 | A1 | 5/2016 | Huerta | |
| 2017/0250578 | A1 | 8/2017 | Kallman | |

OTHER PUBLICATIONS

National Presto Industries, Inc., "Magnetic Cord for Electric Deep Fryers," obtained from http://www.gopresto.com/productslproductslphp?stock=09982. generated Jan. 18, 2006, 1-pg.

Dowell Trading Co, Ltd., "News for Break Away Power Cords on Electric Deep Fryers," copyright 2002, 1-pg.

CNN.com, "Break-away cord aims to make deep fryers safer," obtained from http:/larchives.cnn.com/2001/US/07/03/deep.fryers/, dated Jul. 4, 2001, 2-pgs.

"Zojirushi Hot Water Dipensing Pot Review," obtaind from http://www.pkshiu.comtlof/archive/2005/01/zojirusji-hot-water-dispensing--pot.cndot.review, dated Jan. 5, 2005, 2-pgs.

U.S. Consumer Product Satety Commission, "Consumer Product Safety Review," Winter 2002, vol. 6, No. 3, total of 12-pgs., see p. 5.

* cited by examiner

LOW-PROFILE AXISYMMETRIC POWER CONNECTORS

CROSS REFERENCES TO RELATED APPLICATIONS

This application claims the benefit of U.S. Provisional Patent Application No. 63/083,850, filed Sep. 25, 2020, which is hereby incorporated by reference.

BACKGROUND

The number of types of electronic devices that are commercially available has increased tremendously the past few years and the rate of introduction of new devices shows no signs of abating. Devices such as tablet computers, laptop computers, all-in-one computers, desktop computers, cell phones, storage devices, wearable-computing devices, portable media players, navigation systems, monitors, adapters, and others, have become ubiquitous.

These electronic devices can receive power through power cords that are connected to power converters—colloquially referred to as bricks—that are in turn connected to wall sockets or outlets. These power cords can have a connector insert that can be inserted into a connector receptacle in the electronic device. These connector receptacles are often located in a rear surface or rear panel of the electronic device. For example, these power cords can have a connector insert that is inserted into connector receptacle in a direction that is orthogonal to a rear of the electronic device. This configuration can make it difficult for the connector insert to be inserted by a user positioned at a front side of the electronic device. It can therefore be desirable to provide a connector insert and connector receptacle that can be easily mated.

Many of these electronic devices have become slimmer over time. To save space and improve the appearance of these electronic devices, manufactures are continuing to provide even slimmer or thinner devices. But the size, particularly the depth of a connector receptacle, can limit a device's thickness. Accordingly, it can be desirable to provide connector receptacles having a low-profile.

For some of these electronic devices, it can be desirable to make other connections to convey data signals. Accordingly, it can be desirable to combine these data signals with a power connector system.

Thus, what is needed are power connector systems that are easy to connect, have a low profile, and can convey one or more data signals.

SUMMARY

Accordingly, embodiments of the present invention can provide power connector systems that are easy to connect, have a low profile, and can convey one or more data signals.

An illustrative embodiment of the present invention can provide a power connector system that is easy to connect by providing an axisymmetric connector receptacle and connector insert. Magnets can be used to help guide a connection between a connector insert and a connector receptacle. Canted springs can be used to provide a tactile response to the insertion of the connector insert into the connector receptacle, to help to secure the connector insert in place when mated with the connector insert, and to provide an electrical path for a supply voltage, ground, or other bias voltage or signal. Self-aligning features can be included on either or both the connector insert and the connector receptacle to help guide mating.

Another illustrative embodiment of the present invention can provide a power connector having a low profile. A connector receptacle can include a protrusion supporting a connect-detect contact in the center of the protrusion and a first power contact on the protrusion and around the connect-detect contact. The connector receptacle can further include a second power contact around the protrusion. The second power contact can be separated from the protrusion by a first recess in the connector receptacle. The first power contact can be used to convey a power supply, while the second power contact can be used to convey ground. The power contacts can terminate in flanges that route power, ground, and a connect detect signal in a plane that is orthogonal to a connection direction of mating between the connector receptacle and a corresponding connector insert. Magnets can be placed around the first power contact, the second power contact, and the connect-detect contact to help reduce the depth or profile of the connector receptacle.

Another illustrative embodiment of the present invention can provide a power connector system that is capable of conveying one or more signals. A connector receptacle can include a central housing supporting contacts on an outer surface. The housing can be separated from an annular ground contact by a recess. The connector insert can include a tip formed to fit in the recess in the connector receptacle. Contacts on an inside surface of a housing in the connector insert tip can mate with contacts in the connector receptacle.

Another illustrative embodiment of the present invention can provide a power connector system where a connector insert and a connector receptacle both include a connect-detect contact. Power can be disconnected from the connector insert until the connect-detect contacts are mated. This can help to reduce arcing between power contacts that can otherwise occur during mating of the connector insert and the connector receptacle.

In these and other embodiments of the present invention, flanges, shields, and other conductive portions of a power connector can be formed by stamping, forging, metal-injection molding, deep drawing, machining, micro-machining, screw-machining, 3-D printing, clinching, or other manufacturing process. The conductive portions can be formed of stainless steel, steel, copper, copper-titanium, phosphor-bronze, or other material or combination of materials. They can be plated or coated with nickel, gold, or other material. The nonconductive portions, such as housings and other structures, can be formed using insert molding, injection molding, or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials.

Embodiments of the present invention can provide power connectors including connector receptacles that can be located in various types of devices, such as such tablet computers, laptop computers, desktop computers, all-in-one computers, cell phones, storage devices, wearable-computing devices, portable media players, navigation systems, monitors, adapters, and other devices, as well as corresponding connector inserts.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
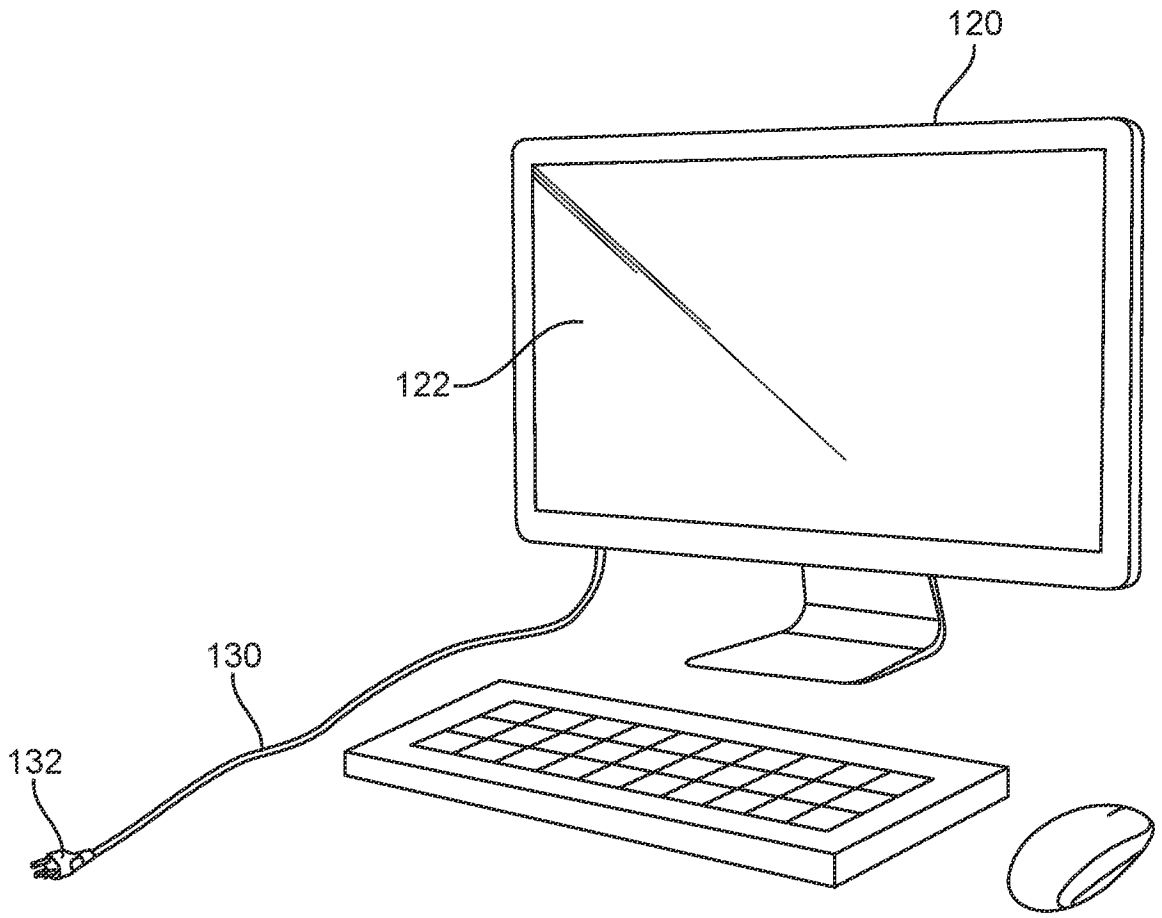
FIG. 1 illustrates an electronic system that can be improved by the incorporation of an embodiment of the present invention.

FIG. 1 illustrates an electronic system that can be improved by the incorporation of an embodiment of the present invention. This figure, as with the other included figures, is shown for illustrative purposes and does not limit either the possible embodiments of the present invention or the claims.

This example illustrates an electronic device 120 having a screen 122. Electronic device 120 can be powered through power cord 130, which can include a plug 132 at a first end. Plug 132 can be configured to plug into a wall socket or outlet. Power cord 130 can be attached to a power converter or brick (not shown.) The power converter can be connected to a cable having a connector insert 700 (shown in FIG. 7) that can plug into a connector receptacle 200 (shown in FIG. 2) located on a rear side or other portion of electronic device 120. Electronic device 120 can be a monitor, desktop computer, all-in-one computer, or other electronic device. In these and other embodiments of the present invention, other devices, such as tablet computers, laptop computers, cell phones, storage devices, wearable-computing devices, portable media players, navigation systems, adapters, and other devices, can be powered using connector receptacle 200.

Figure 2:
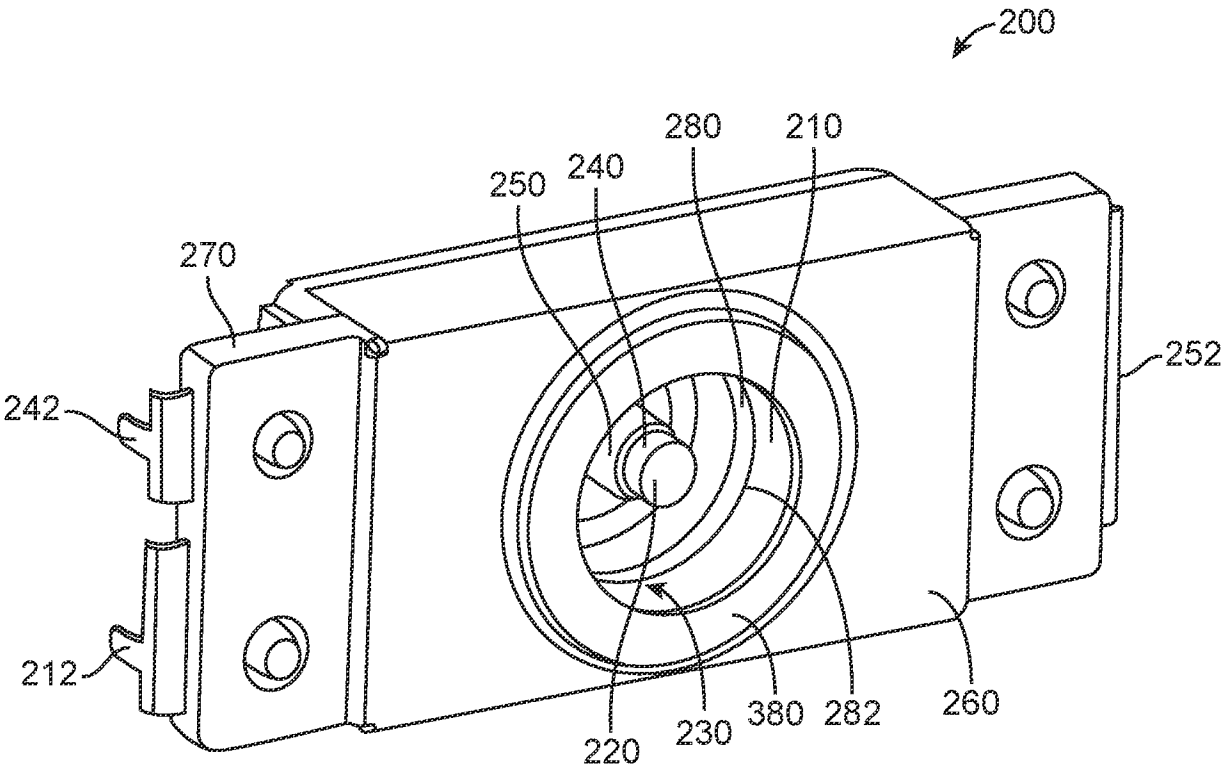
FIG. 2 illustrates a connector receptacle according to an embodiment of the present invention.

FIG. 2 illustrates a connector receptacle according to an embodiment of the present invention. Connector receptacle 200 can include ground ring 210 surrounding protrusion 220. Ground ring 210 can be used to convey a ground, though in these and other embodiments of the present invention, ground ring 210 can convey a power supply or other voltage. Trim ring 380 can secure ground ring 210 in place. Ground ring 210 can be separated from protrusion 220 by recess 230. Protrusion 220 can support a connect-detect contact 240 and power supply contact 250. Power supply contact 250 can be used to convey a power supply voltage, though in these and other embodiments of the present invention, power supply contact 250 can convey a ground or other voltage. Connect-detect contact 240 and power supply contact 250 can be separated by insulator 520 (shown in FIG. 5.) Connect-detect contact 240 can connect to flange 440 (shown in FIG. 4), which can terminate in tab 242. Power supply contact 250 can connect to flange 450 (shown in FIG. 4), which can terminate in tab 252. Ground ring 210 can connect to flange 410 (shown in FIG. 4), which can terminate in tab 212. Flange 410, flange 440, and flange 450 can be supported by housing 270. For example, housing 270 can be insert molded around portions of flange 410, flange 440, and flange 450. Connector receptacle 200 can be shielded by front shield 260. Canted spring 280 can be located in groove 282 in ground ring 210. The arrangement of flange 410, flange 440, and flange 450 extending laterally to tab 212, tab 242, and tab 252 can provide connector receptacle 200 with a shallow depth such that connector receptacle 200 can allow electronic device 120 to have a reduced thickness.

Figure 3:
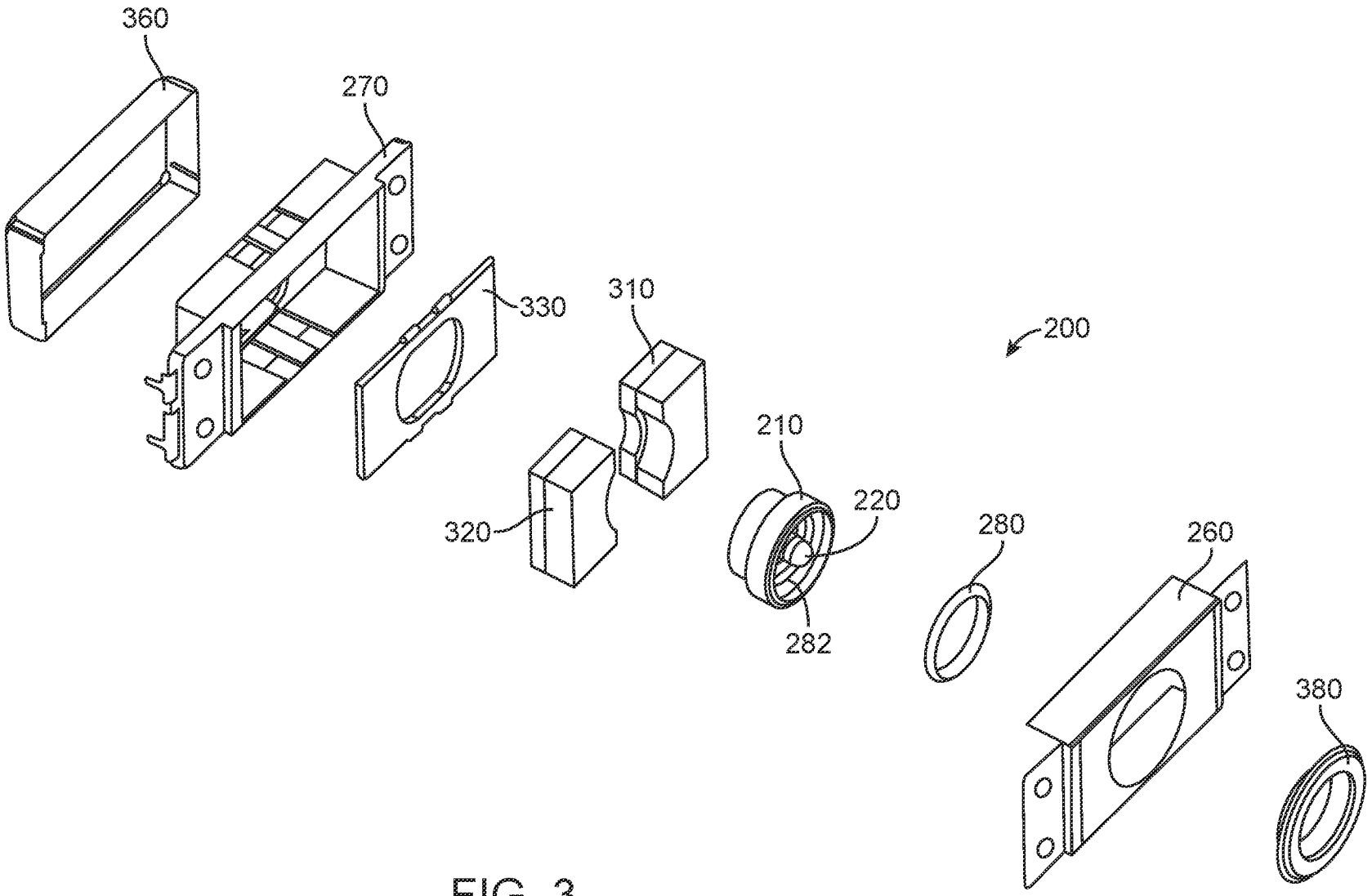
FIG. 3 is an exploded view of the connector receptacle of FIG. 2.

FIG. 3 is an exploded view of the connector receptacle of FIG. 2. Connector receptacle 200 can include ground ring 210 surrounding protrusion 220. Canted spring 280 can be located in groove 282 of ground ring 210. Trim ring 380 can attach to ground ring 210 and front shield 260 to hold ground ring 210 in place. Magnet 310 and magnet 320 can be placed laterally on sides of ground ring 210. Backplate 330 can be attached to or otherwise located adjacent to back surfaces of magnets 310 and 320. Housing 270 can support backplate 330, magnet 310, and magnet 320, as well as ground ring 210. Shield 360 can cover a backside of housing 270 and can be attached to front shield 260 by laser or spot-welding or other technique.

Figure 4:
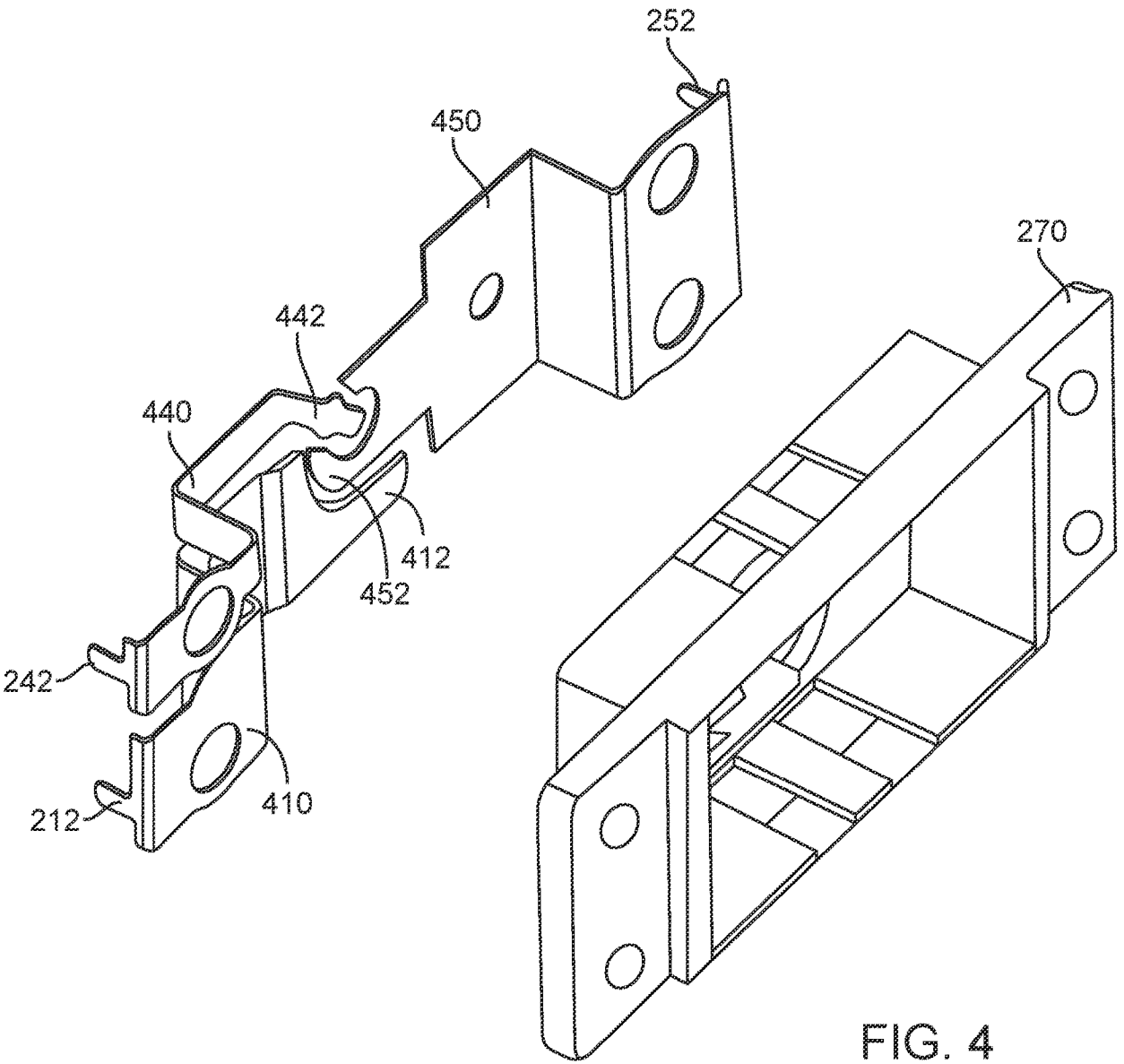
FIG. 4 illustrates a portion of the connector receptacle of FIG. 2.

FIG. 4 illustrates a portion of the connector receptacle of FIG. 2. Ground ring 210 (shown in FIG. 2) can physically and electrically connect to location 412 of flange 410, which can terminate in tab 212. Connect-detect contact 240 (shown in FIG. 2) can physically and electrically connect to flange 440 at location 442. Flange 440 can terminate in tab 242. Power supply contact 250 (shown in FIG. 2) can physically and electrically connect to location 452 of flange 450, which can terminate in tab 252. Tab 212, tab 242, and tab 252 can be inserted into and soldered to openings in a printed circuit board or other appropriate substrate (not shown.) While tab 212, tab 242, and tab 252 are shown as through-hole contacting portions, some or all of tab 212, tab 242, and tab 252 can be surface-mount contacting portions. Flange 410, flange 440, and flange 450 can be supported on a backside of housing 270, housing 270 can be formed around portions of flange 410, flange 440, and flange 450, for example by insert molding or other technique, or other arrangements can be made.

Figure 5:
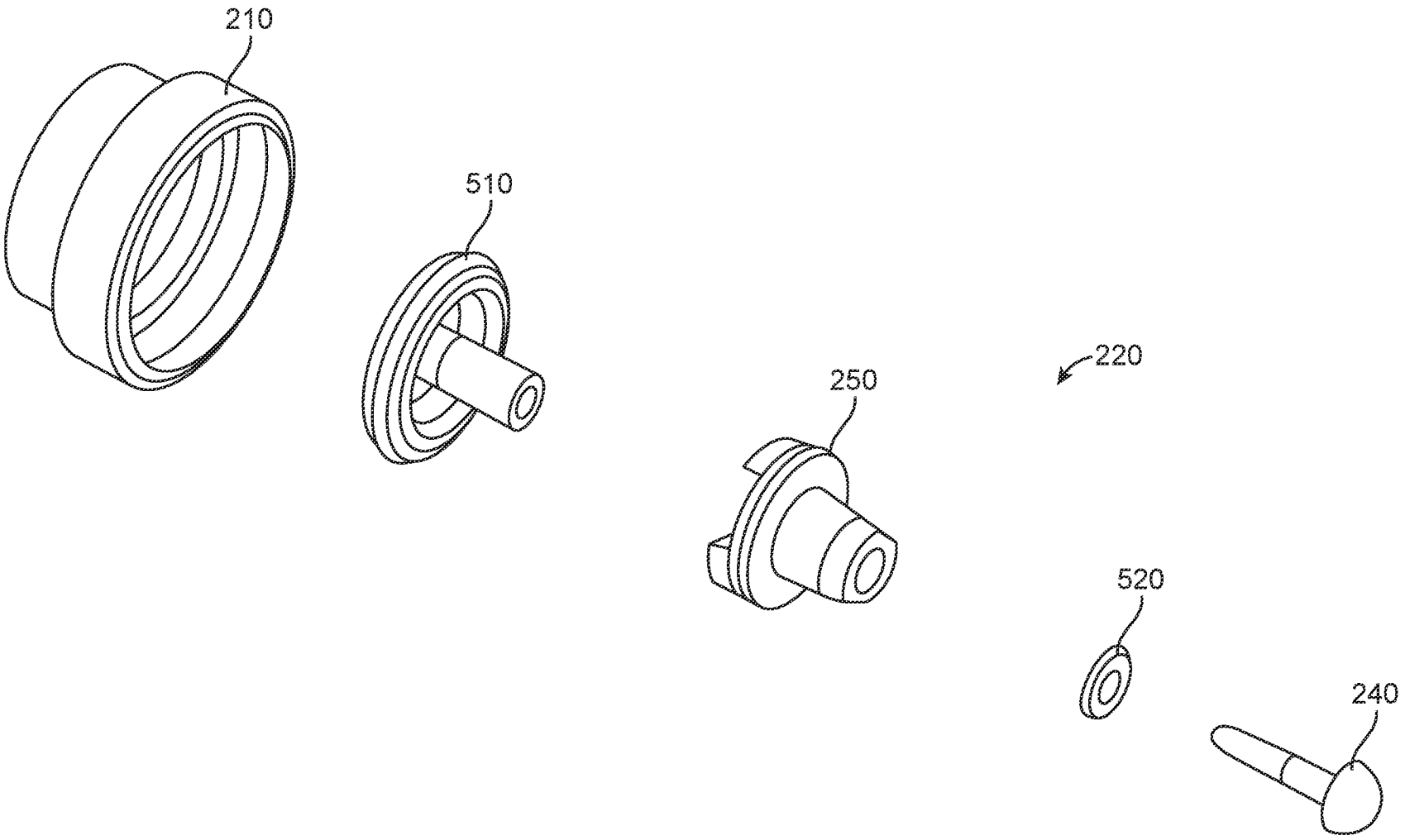
FIG. 5 illustrates another portion of the connector receptacle of FIG. 2.

FIG. 5 illustrates another portion of the connector receptacle of FIG. 2. Protrusion 220 can be formed by power supply contact 250, insulator 520, and connect-detect contact 240. Protrusion 220 can be fit into ground ring 210 and electrically insulated from ground ring 210 by insulator 510. Insulator 510 can further insulate connect-detect contact 240 from power supply contact 250.

Figure 6:
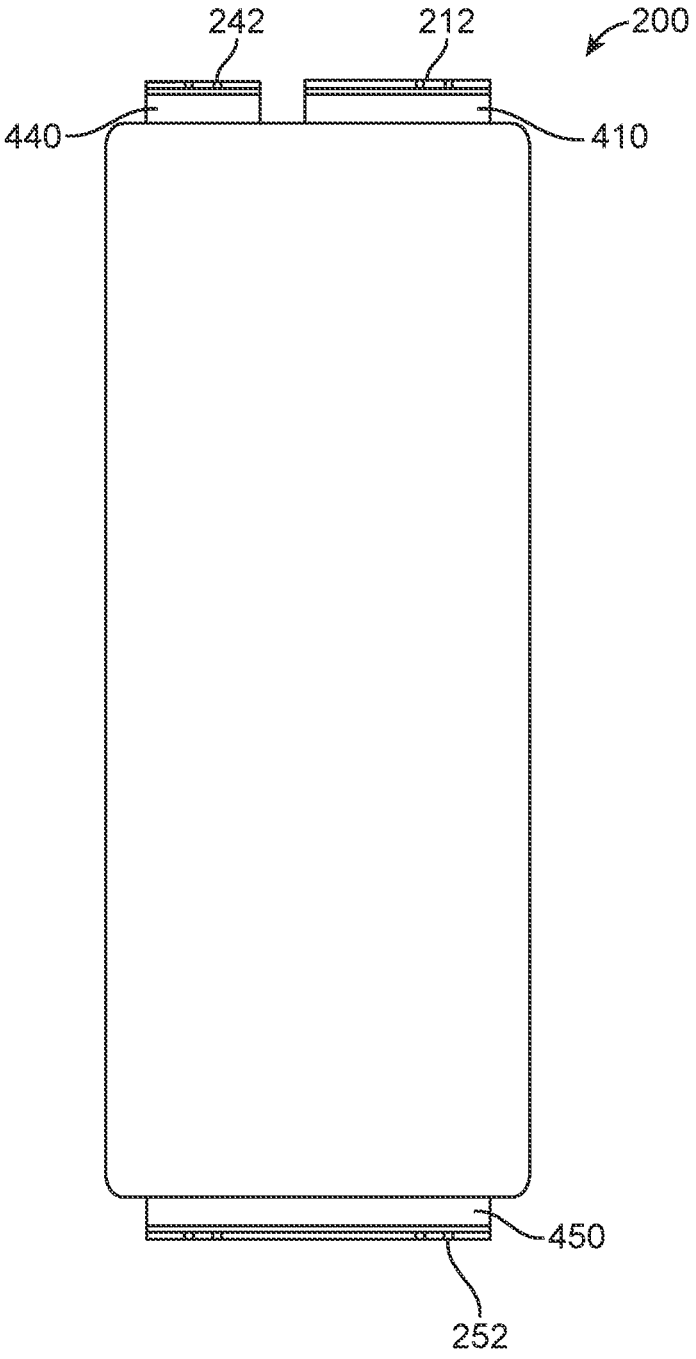
FIG. 6 illustrates a rear view of the connector receptacle of FIG. 2.

FIG. 6 illustrates a rear view of the connector receptacle of FIG. 2. Connector receptacle 200 can include flanges for routing power and signals. In this example, flange 410 can be used to route ground to tab 212. Flange 440 can be used to route a connect-detect signal to tab 242. Power supply flange 450 can route a power supply to tab 252.

Figure 7:
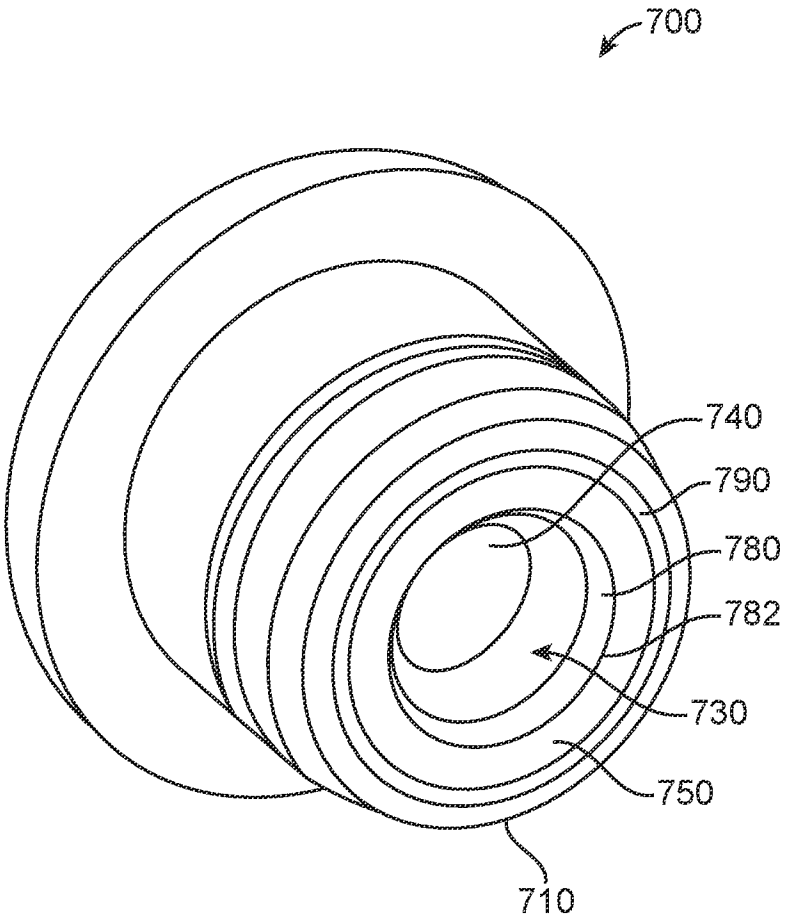
FIG. 7 illustrates a connector insert according to an embodiment of the present invention.

FIG. 7 illustrates a connector insert according to an embodiment of the present invention. Connector insert 700 can include ground contact 710 encircling power supply contact 750. Ground contact 710 can convey a ground, through in these and other embodiments of the present invention, ground contact 710 can convey a power supply voltage or other voltage. Power supply contact 750 can convey a power supply voltage, through in these and other embodiments of the present invention, power supply contact 750 can convey a ground or other voltage. Ground contact 710 can be isolated from power supply contact 750 by insulator 790. Canted spring 780 can be located in groove 782 in power supply contact 750. Power supply contact 750 can define recess 730. Connect-detect contact 740 can be located in recess 730. In this configuration, connector insert 700 can include a cylinder around connect-detect contact 740, where an outside of the cylinder includes ground contact 710 and an inside of the cylinder includes power supply contact 750.

Figure 8:
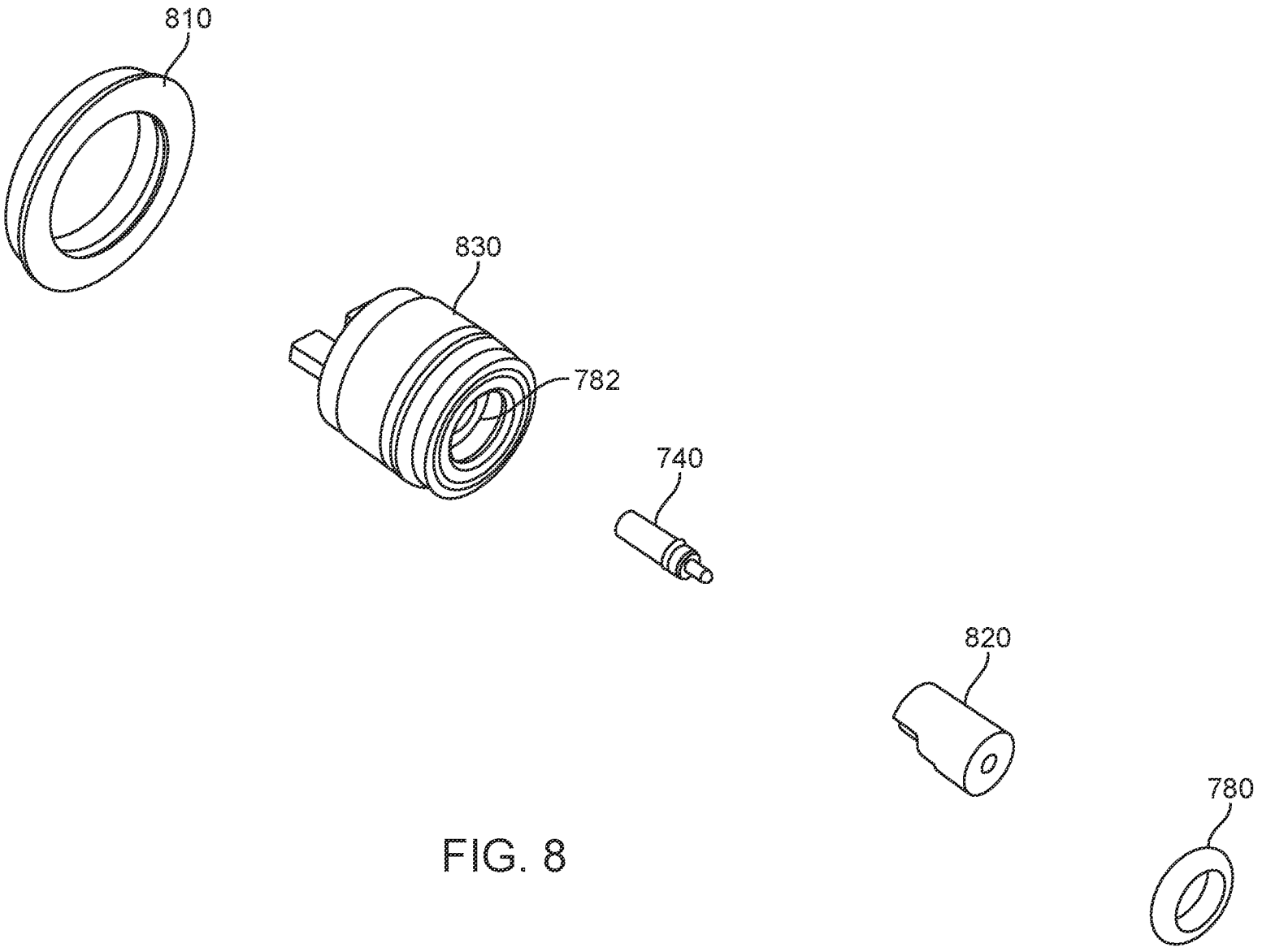
FIG. 8 illustrates a portion of the connector insert of FIG. 7.

FIG. 8 illustrates a portion of the connector insert of FIG. 7. Plug tip 830 can include groove 782. Canted spring 780 can be located in groove 782. Connect-detect contact 740 can be insulated by insulator 820. Ring 810 can be located around plug tip 830.

Figure 9:
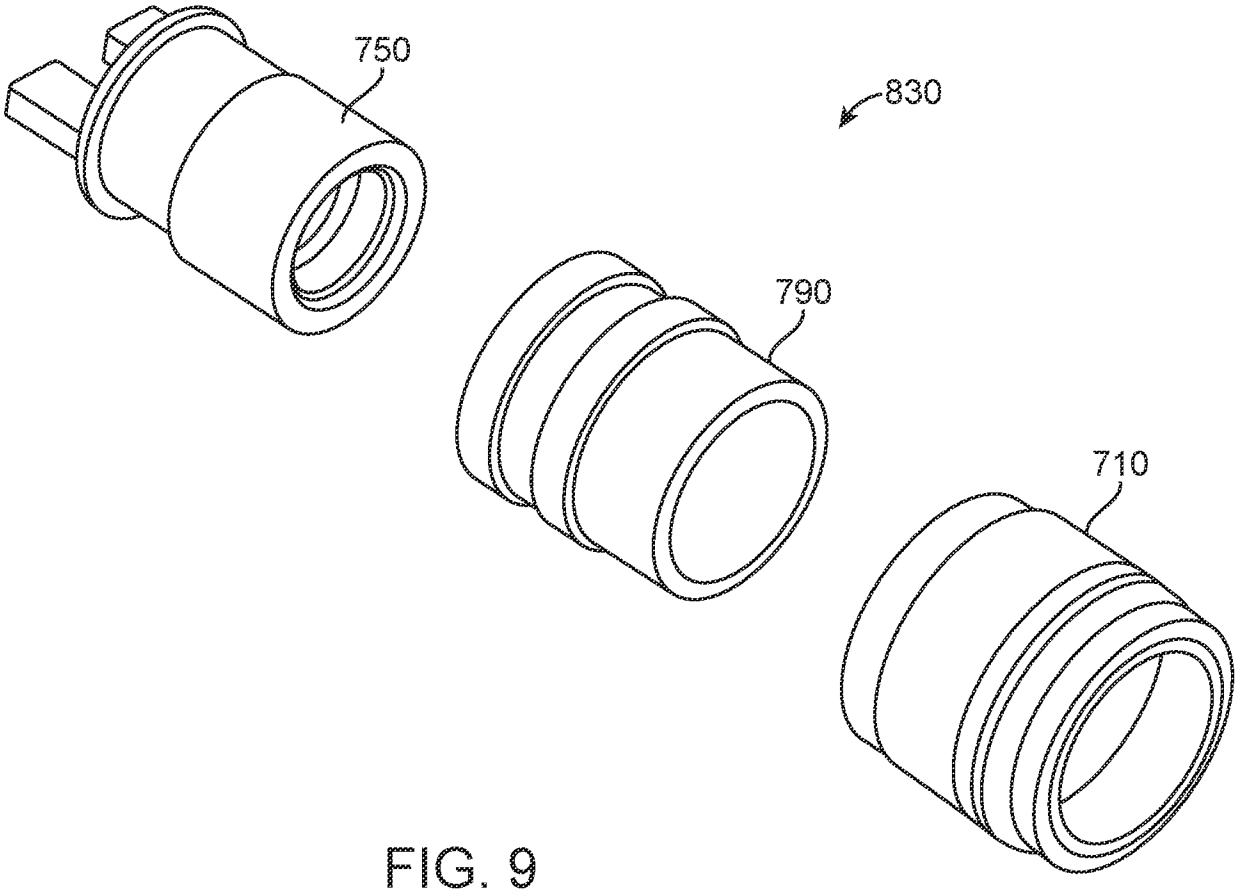
FIG. 9 illustrates details of a plug tip for the connector insert of FIG. 7.

FIG. 9 illustrates details of a plug tip for the connector insert of FIG. 7. Plug tip 830 can include ground contact 710 and power supply contact 750 separated by insulator 790.

Figure 10:
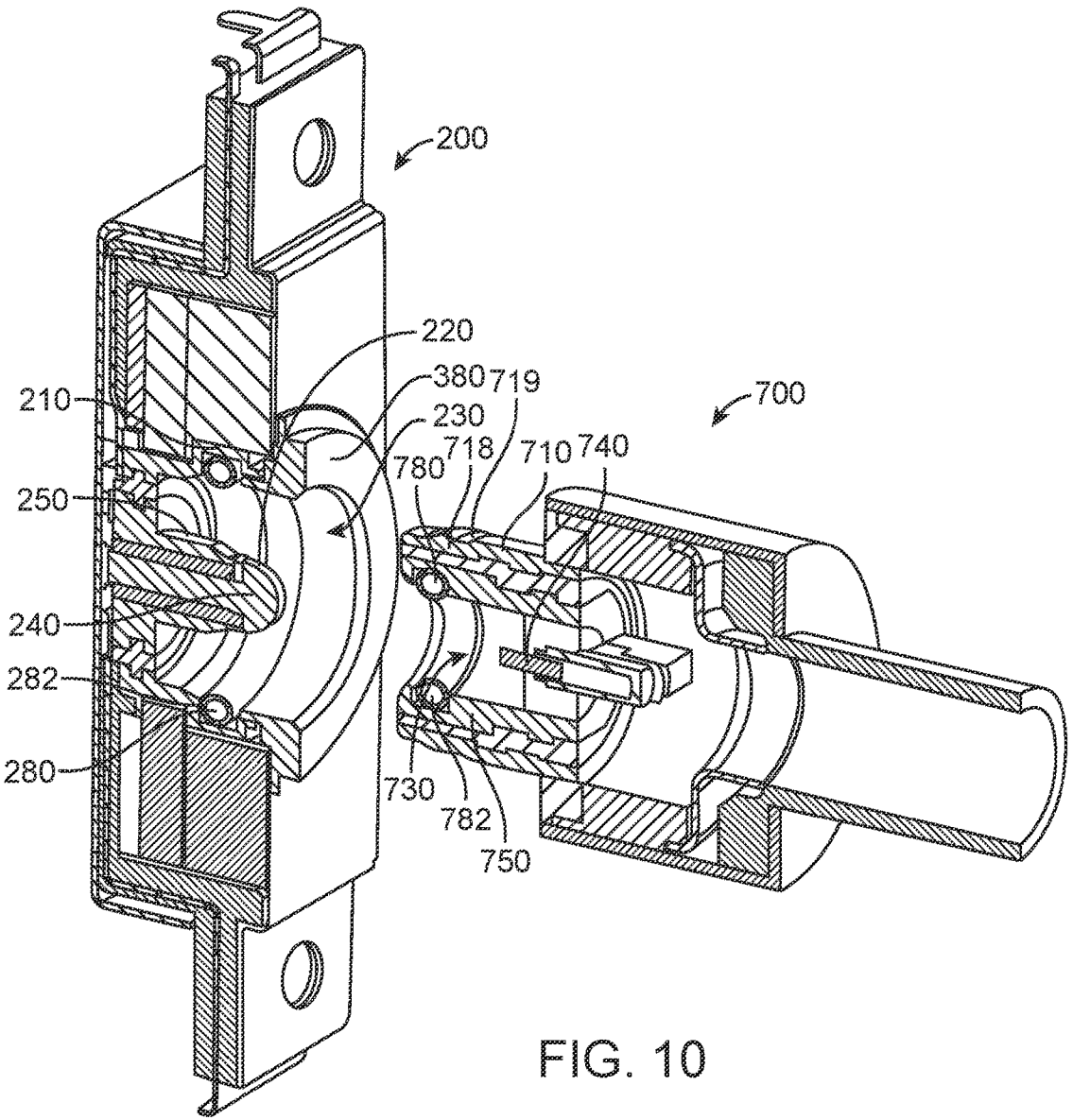
FIG. 10 illustrates a cross-section view of a power connector system according to an embodiment of the present invention.

FIG. 10 illustrates a cross-section of a power connector system according to an embodiment of the present invention. In this example, connector receptacle 200 can be positioned near connector insert 700. Protrusion 220 of connector receptacle 200 can fit in recess 730 in connector insert 700 when connector insert 700 is mated with connector receptacle 200. Connect-detect contact 240 in connector receptacle 200 can physically and electrically connect to connect-detect contact 740 in connector insert 700. Power supply contact 250 on protrusion 220 can physically and electrically connect to power supply contact 750 on connector insert 700. Ground contact 710 on connector insert 700 can fit in recess 230 in connector receptacle 200. Ground contact 710 on connector insert 700 can physically and electrically connect to ground ring 210 and trim ring 380 in connector receptacle 200.

Canted spring 280 can fit in groove 282 in ground ring 210 of connector receptacle 200. Canted spring 280 can engage contour 718 and contour 719 on ground contact 710 of connector insert 700. Specifically, contour 718 can have a larger diameter than contour 719. Canted spring 780 can fit in groove 782 in power supply contact 750 of connector insert 700. Canted spring 780 can engage protrusion 220 in connector receptacle 200. Canted spring 780 can be used as a current path for power between power supply contact 750 and power supply contact 250, while canted spring 280 can be used as a current path for ground between ground ring 210 and ground contact 710. Canted spring 780 and canted spring 280 can further provide a tactile response to a user when the user inserts and extracts connector insert 700 into and from connector receptacle 200.

Figure 11C:
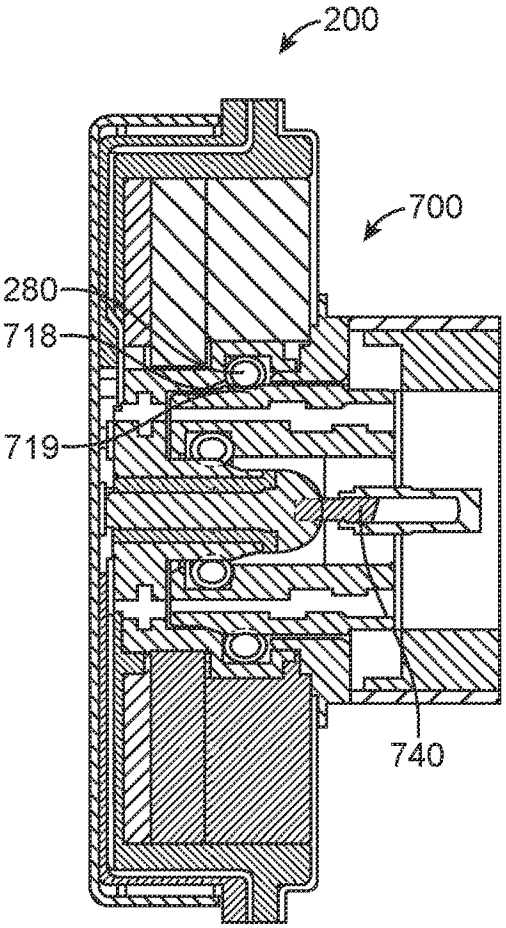
FIGS. 11A through 11C illustrate a connection sequence for the power connector system of FIG. 10.
Figure 11B:
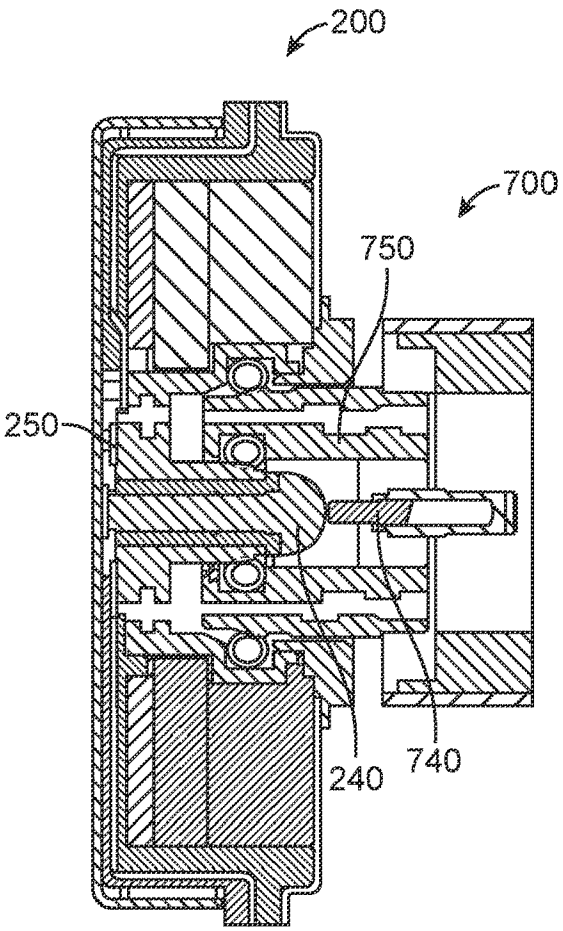
Figure 11A:
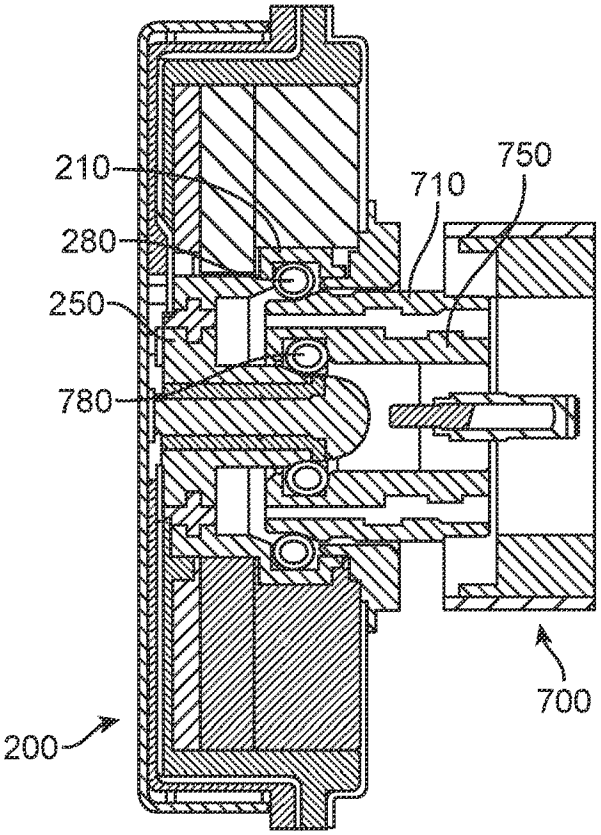

FIGS. 11A through 11C illustrate a connection sequence for the power connector system of FIG. 10. In FIG. 11A, canted spring 280 can begin to engage ground contact 710 thereby forming a ground path through ground ring 210 and canted spring 280 of connector receptacle 200 and ground contact 710 of connector insert 700. Similarly, canted spring 780 can begin to engage power supply contact 250 in connector receptacle 200 thereby forming a current path through power supply contact 750 and canted spring 780 in connector insert 700 and power supply contact 250 in connector receptacle 200. In FIG. 11B, connect-detect contact 240 in connector receptacle 200 can begin to engage connect-detect contact 740 in connector insert 700. Previous to this engagement, power might not be applied to power supply contact 750 in connector insert 700. Once connect-detect contact 240 engages connect-detect contact 740, power can be applied to power supply contact 750. This can ensure that arcing is reduced or does not occur between power supply contact 750 and power supply contact 250 as connector insert 700 is mated with connector receptacle 200. Either or both connect-detect contact 240 and connect-detect contact 740 can be a spring-biased contact. For example, connect-detect contact 740 can be a spring-biased contact. In this case, in FIG. 11C, connect-detect contact 740 can be compressed as connector insert 700 is fully inserted into connector receptacle 200.

Also, in FIG. 11B, canted spring 280 can begin to engage contour 718 of ground contact 710. This can widen or increase a diameter of ground contact 710. In FIG. 11C, connector insert 700 can be mated with connector receptacle 200. At this time, canted spring 280 can be seated in contour 719. Since contour 719 can be narrower than contour 718, this can allow canted spring 280 to reverse direction thereby helping to secure connector insert 700 in place in connector receptacle 200.

More specifically, these and other embodiments of the present invention can utilize canted spring 280 and canted spring 780 (also referred to as a canted coil spring.) Canted spring 280 (and canted spring 780) can have the following properties: First, when canted spring 280 is relaxed or in a groove geometry that allows the cant-direction to flip into one of two stable directions, canted spring 280 might only provide a nominal resistance to an insertion and extraction; and second, when canted spring 280 is in a constrained groove and compressed radially, canted spring 280 can enter a state where canted spring 280 provides a nominal resistance to an insertion (more specifically, a nominal resistance to movement in the same direction) and a large resistance to an extraction (more specifically, a large resistance to movement in the opposing direction). As such, when connector insert 700 is inserted into connector receptacle 200, canted spring 280 can be positioned in a constrained groove and can provide minimal insertion resistance. Once connector insert 700 is in place in connector receptacle 200, so long as canted spring 280 remains in the constrained groove, canted spring 280 can provide a large resistance to an extraction of connector insert 700. This can help to avoid an inadvertent extraction of connector insert 700 from connector receptacle 200. In order to release connector insert 700, the groove geometry can be altered, thereby allowing the cant-direction to flip on extraction reducing the resistance to the extraction of connector insert 700.

Again, as connector insert 700 is inserted into connector receptacle 200 in FIG. 11B, canted spring 280 can begin to encounter contour 718, which can be a widening in a diameter of ground contact 710. Since canted spring 280 is in the relaxed state and not compressed radially in a constrained groove, only a nominal insertion force is needed to insert connector insert 700 into connector receptacle 200. As canted spring 280 engages widened contour 718, canted spring 280 can be stretched over the larger diameter of contour 718. In FIG. 11C, once canted spring 280 reaches narrowed contour 719 of ground contact 710, connector insert 700 is fully inserted into connector receptacle 200. At this position, canted spring 280 can enter a constrained groove and can provide a significant resistance to an extraction of connector insert 2200. Connector insert 700 can be extracted from connector receptacle 200 by exerting sufficient force on connector insert 700. After contour 719 passes through canted spring 280, canted spring 280 can relax to the narrower diameter of ground contact 710. This can allow the cant-direction of canted spring 280 to flip upon extraction and cause canted spring 280 to provide only a nominal resistance to the further extraction of connector insert 700 from connector receptacle 200. Once connector insert 700 has been fully extracted from connector receptacle 200, canted spring 280 can be in a relaxed state and can provide a nominal resistance to the next insertion of connector insert 700. Canted spring 780 can operate in a similar manner in these and other embodiments of the present invention.

In these and other embodiments of the present invention, connector insert 700 can mate with connector receptacle 200 in an axisymmetric manner. This can simplify the forming of a connection between connector insert 700 and connector receptacle 200 since connector insert 700 can be inserted into connector receptacle 200 in any rotational angle.

Again, it can be desirable to pass signals as well as power through a power connector. An example is shown in the following figure.

Figure 12:
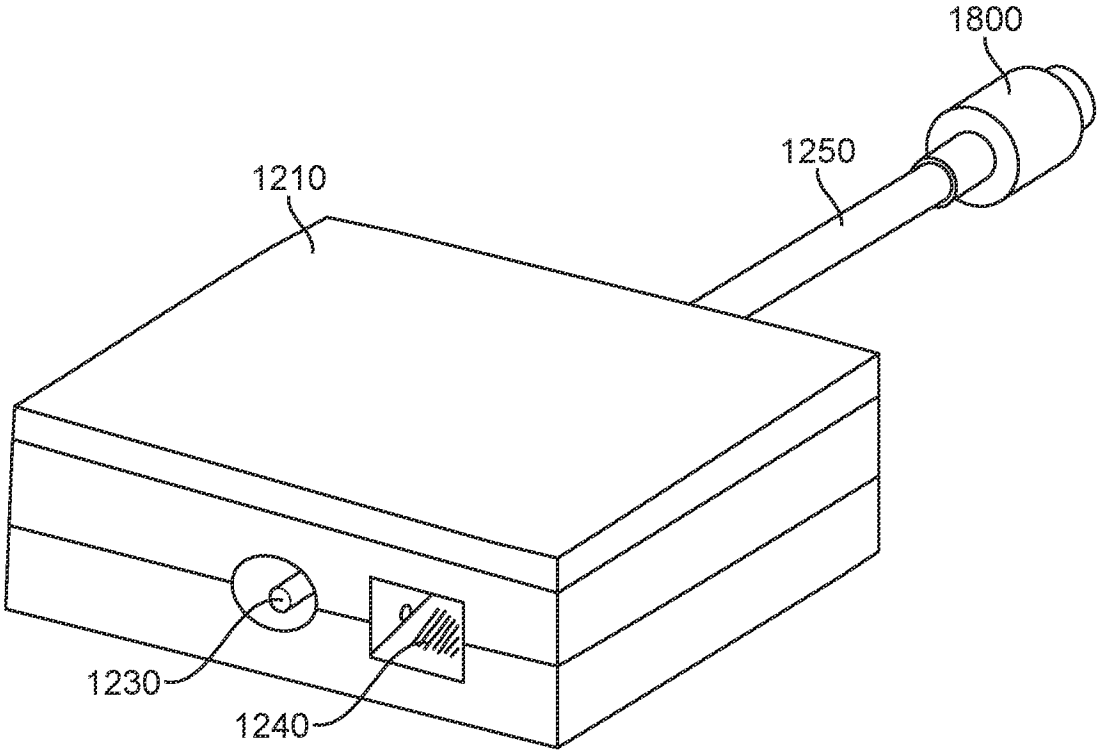
FIG. 12 illustrates a power supply component according to an embodiment of the present invention.

FIG. 12 illustrates a power supply component according to an embodiment of the present invention. Power brick 1210 can accept AC power at connector receptacle 1230. Power brick 1210 can further include connector receptacle 1240. Connector receptacle 1240 can be an Ethernet, lightning, USB C, or other type of connector receptacle. Power from connector receptacle 1230 and signals from connector receptacle 1240 can be provided over cable 1250 to connector insert 1800. Connector insert 1800 can be arranged to mate with connector receptacle 1300, shown in the following figure.

Figure 13:
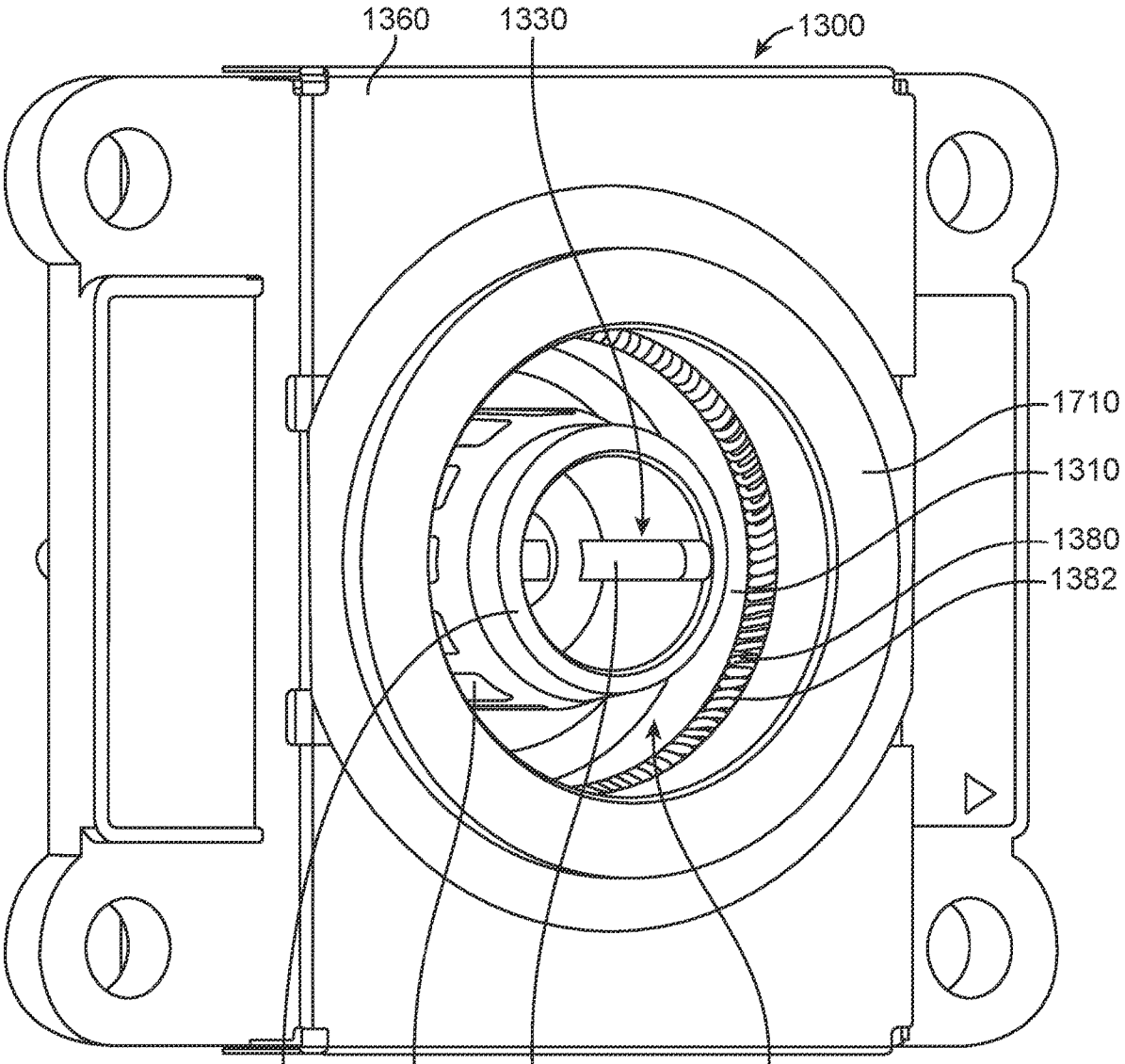
FIG. 13 illustrates a connector receptacle according to an embodiment of the present invention.

FIG. 13 illustrates a connector receptacle according to an embodiment of the present invention. Connector receptacle 1300 can be used as connector receptacle 200 in FIG. 1 or as a connector receptacle in these and other embodiments of the present invention. Connector receptacle 1300 can include trim ring 1710 that can be attached to ground ring 1310 and front shield 1360, thereby securing ground ring 1310 in place. Ground ring 1310 can define first recess 1320. Housing 1340 can be located in first recess 1320 and can define second recess 1330. Contacts 1350 can be supported by housing 1340. Contacts 1350 can convey signals, one or more power supplies, ground, or other currents or voltages of interest. Keying features 1342 can be located on housing 1340. Ground ring 1310 can convey a ground, though in these and other embodiments of the present invention, ground ring 1310 can convey a power supply voltage or other voltage.

Canted spring 1380 can be located in groove 1382 in ground ring 1310. But in some circumstances, a canted spring, such as canted spring 1380 can inadvertently become dislodged from groove 1382. Accordingly, embodiments of the present invention can provide features to improve the retention of canted spring 1380 in groove 1382. Examples are shown in the following figures.

Figure 14:
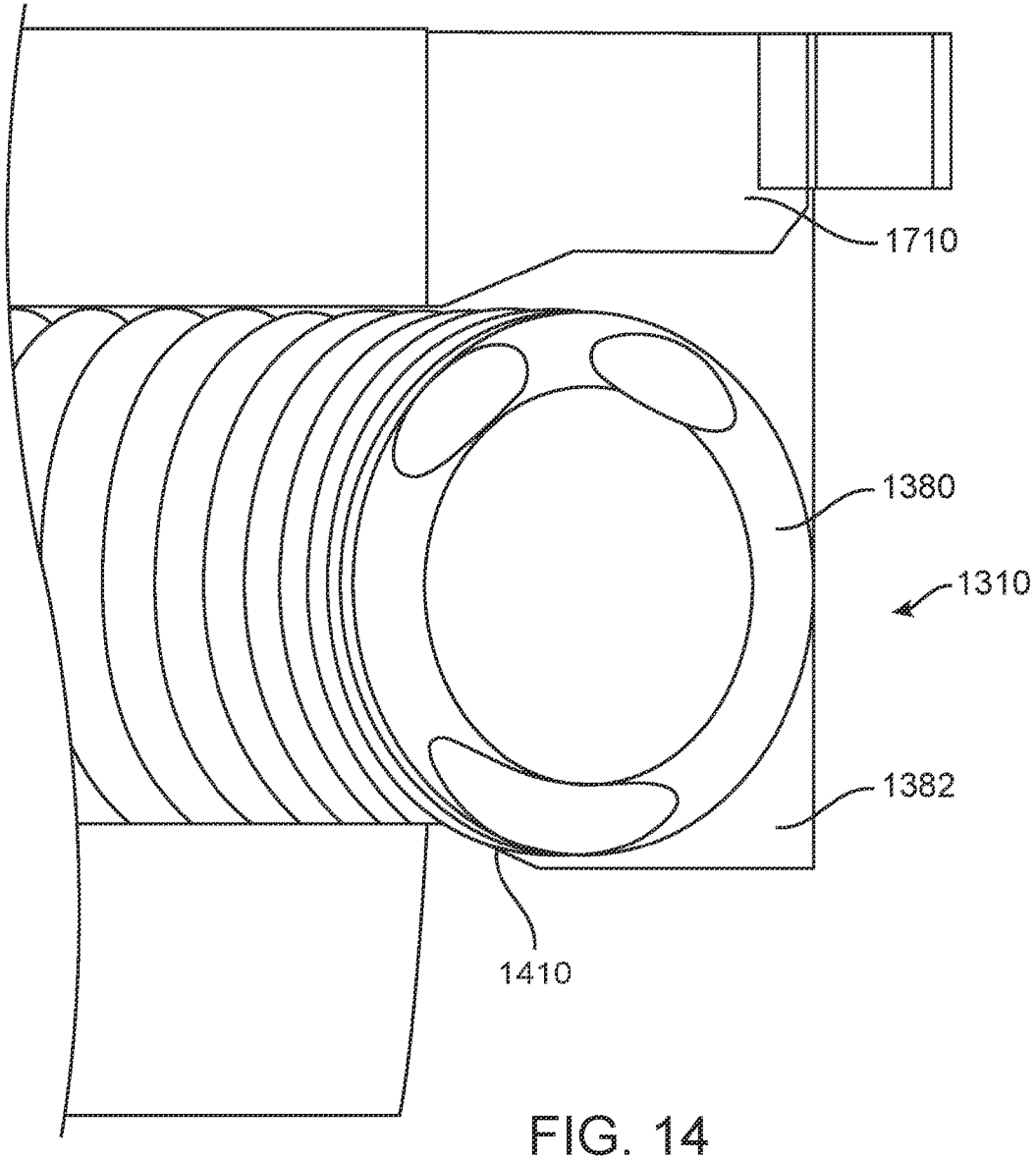
FIG. 14 illustrates an improved arrangement for securing a canted spring according to an embodiment of the present invention.

FIG. 14 illustrates an improved arrangement for securing a canted spring according to an embodiment of the present invention. Canted spring 1380 can be located in groove 1382. Groove 1382 can include a dovetailed front edge 1410. Dovetailed front edge 1410 can form a narrowing in groove 1382 that can help to retain canted spring 1380 in place. In this example, groove 1382 can be formed by edges of trim ring 1710 and ground ring 1310.

Figure 15:
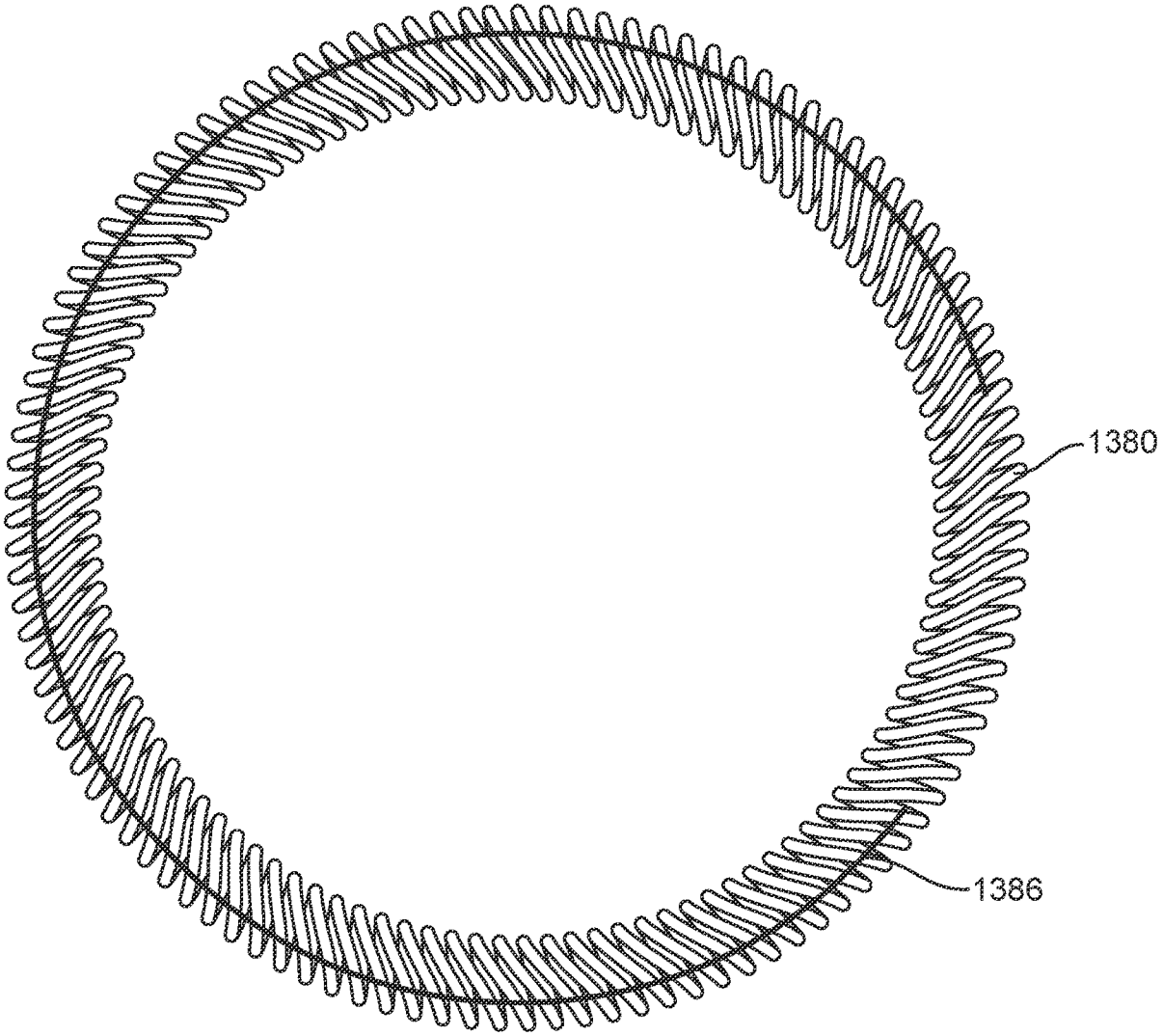
FIG. 15 illustrates an improved canted spring according to an embodiment of the present invention.

FIG. 15 illustrates an improved canted spring according to an embodiment of the present invention. In this example, canted spring 1380 can include C-clip 1386. C-clip 1368 can be surrounded by windings of canted spring 1380. C-clip 1386 can act to stiffen canted spring 1380 thereby improving its ability to be retained in groove 1382, for example, as shown in FIG. 14.

Figure 16:
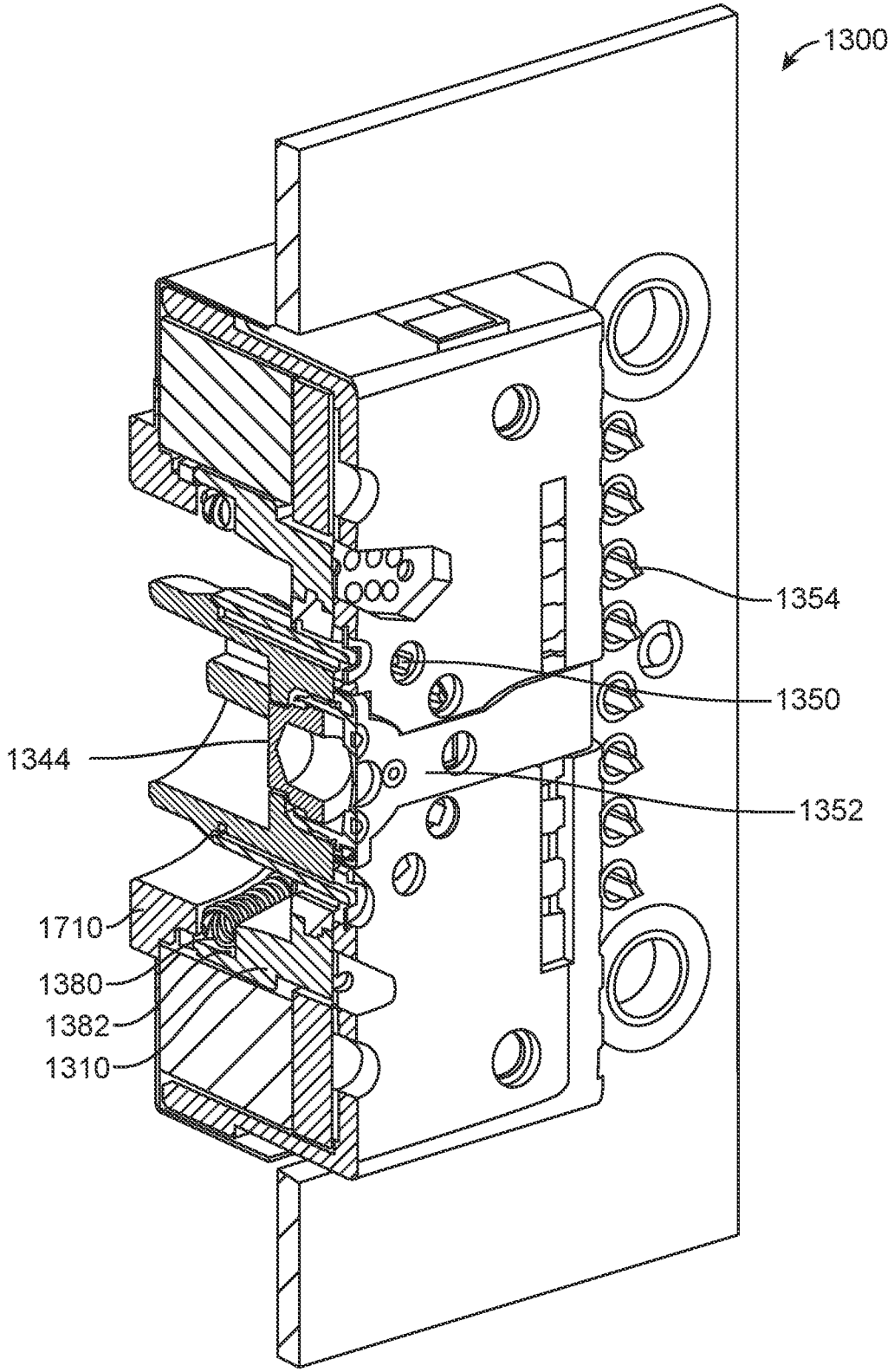
FIG. 16 illustrates a cross-section view of the connector receptacle of FIG. 13.

FIG. 16 illustrates a cutaway side view of the connector receptacle of FIG. 13. Connector receptacle 1300 can include trim ring 1710 and ground ring 1310 forming groove 1382 for canted spring 1380. Contacts 1350 can be soldered, welded, or otherwise attached to contact bodies (not shown) that can terminate in through-hole contacting portions 1354 on a backside of connector receptacle 1300. Connect-detect contact 1344 can be soldered, welded, or otherwise attached to connect detect contact body 1352.

Figure 17:
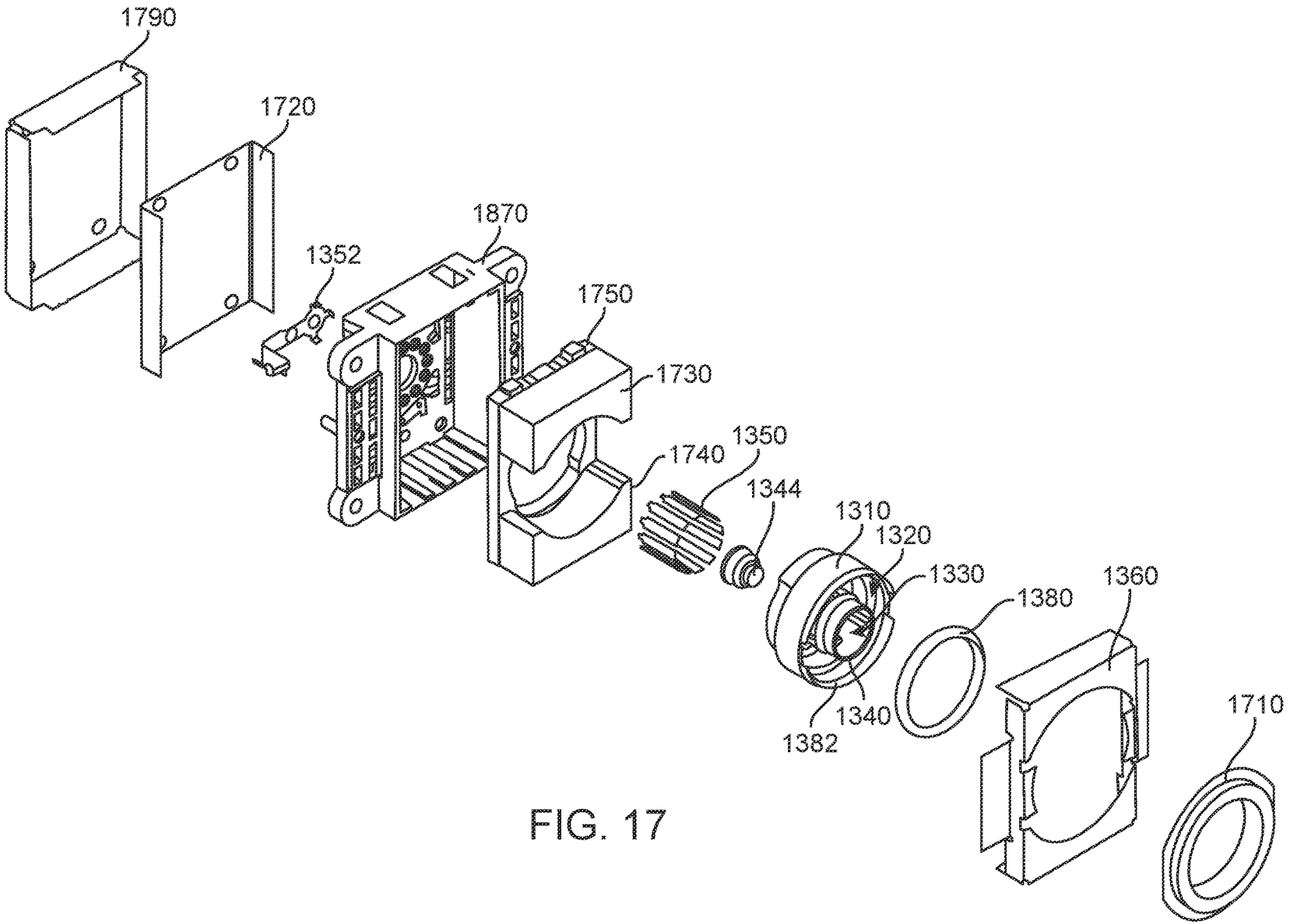
FIG. 17 is an exploded view of the connector receptacle of FIG. 13.

FIG. 17 is an exploded view of the connector receptacle of FIG. 13. Trim ring 1710 can be used to secure ground ring 1310 to front shield 1360. Canted spring 1380 can fit in groove 1382 between ground ring 1310 and trim ring 1710. Ground ring 1310 can define first recess 1320. Housing 1340 can be located in first recess 1320 and can define second recess 1330. Connect-detect contact 1344 can be located in second recess 1330 and can be soldered, welded, or otherwise attached to connect detect contact body 1352. Contacts 1350 can be supported by housing 1340. Magnet 1730 and magnet 1740 can be supported by backplate 1750 and can be laterally positioned on sides of ground ring 1310. Magnet 1730, magnet 1740, and backplate 1750 can be supported by housing 1870. Contact bodies (not shown) can connect to contacts 1350. Tape 1720 can secure shield 1790 to housing 1870. Housing 1870 can be molded around the contact bodies, for example using insert molding or other technique.

Figure 18A:
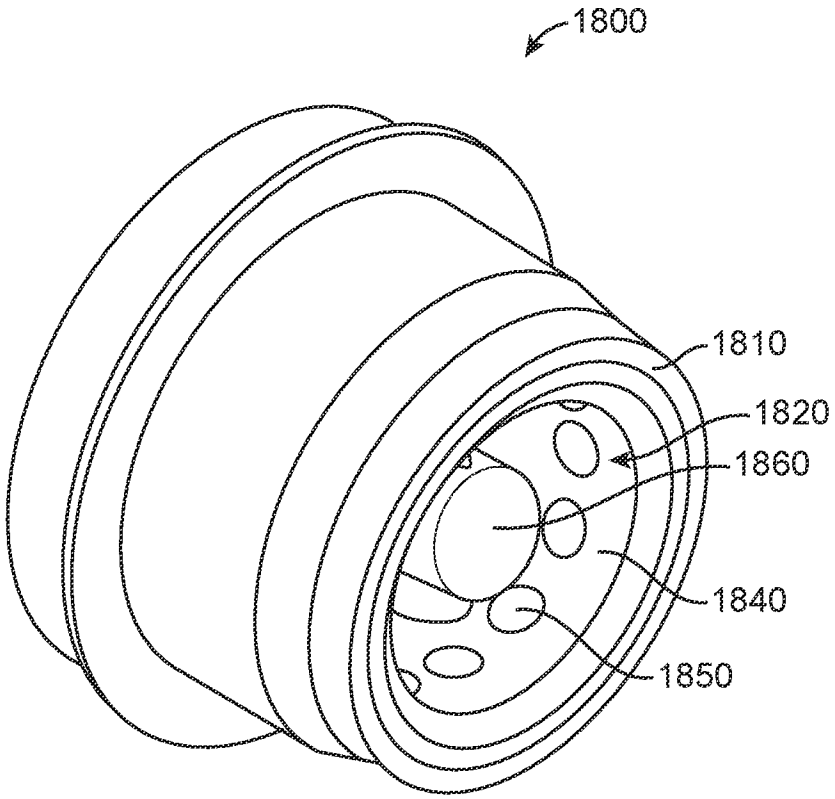
FIG. 18A illustrates a connector insert according to an embodiment of the present invention.

FIG. 18A illustrates a connector insert according to an embodiment of the present invention. In this example, connector insert 1800 can include ground contact 1810 around housing 1840. Housing 1840 can support contacts 1850. Contacts 1850 can convey signals, one or more power supplies, grounds, or other currents or voltages of interest. Housing 1840 can define recess 1820. Connect-detect contact 1860 can be located in recess 1820. Ground contact 1810 can convey a ground, through in these and other embodiments of the present invention, ground contact 1810 can convey a power supply voltage or other voltage.

Figure 18B:
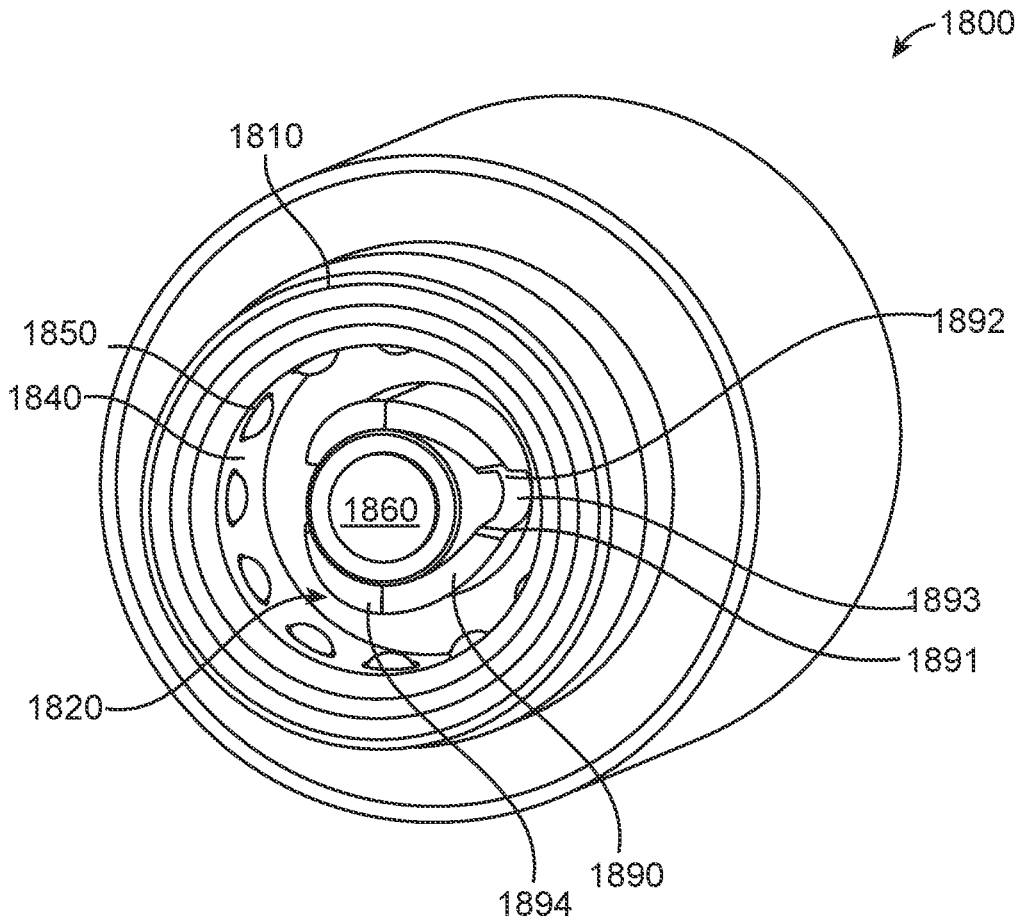
FIG. 18B illustrates another view of a connector insert according to an embodiment of the present invention.

FIG. 18B illustrates another view of a connector insert according to an embodiment of the present invention. As before, connector insert 1800 can include ground contact 1810 around housing 1840. Housing 1840 can support contacts 1850. Contacts 1850 can convey signals, one or more power supplies, grounds, or other currents or voltages of interest. Housing 1840 can define recess 1820. Connect-detect contact 1860 can be located in recess 1820. Cam 1890 can be located around connect-detect contact 1860.

When connector insert 1800 is mated with a corresponding connector receptacle, such as connector receptacle 1300 (shown in FIG. 13), corresponding contacts 1850 in connector insert 1800 can align with corresponding contacts 1350 (shown in FIG. 13) in connector receptacle 1300. That is, a contact 1850 to convey a power supply can rotationally align and mate with a corresponding contact 1350 to convey the power supply. Similarly, a contact 1850 to convey a first signal can rotationally align and mate with a corresponding contact 1350 to convey the first signal. But it can be difficult to rotationally align a connector insert with a corresponding connector receptacle in such a way that all contacts are properly aligned. This can be particularly true when an insertion of connector insert 1800 into connector receptacle 1300 is made on a backside of electronic device 120 (shown in FIG. 1) and out of view of a user making the insertion.

Accordingly, embodiments of the present invention can provide self-aligning features for connector insert 1800 and connector receptacle 1300 that can facilitate the insertion of connector insert 1800 into connector receptacle 1300. For example, side notches 1891 on cam 1890 of connector insert 1800 can engage keying features 1342 (shown in FIG. 13) of connector receptacle 1300. Cam 1890 can include curved front surface 1894. During insertion, when curved front surface 1894 of cam 1890 engages keying features 1342, connector insert 1800 can naturally begin to rotate in a user's hand. As the insertion continues, keying features 1342 can begin to engage a side 1892 on each of side notches 1891 of cam 1890. As insertion is complete, keying features 1342 can bottom out and reach or approach bottom 1893 of side notches 1891.

In this way, connector insert 1800 can mate with connector receptacle 1300 in either of two orientations rotationally separated by 180 degrees. As a result, each contact 1850 in connector insert 1800 can mate with one of two contacts 1350 in connector receptacle 1300, where the two contacts 1350 are opposing contacts rotationally spaced by 180 degrees. Also, each contact 1350 in connector receptacle 1300 can mate with one of two contacts 1850 in connector insert 1800, where the two contacts 1850 are opposing contacts rotationally spaced by 180 degrees.

Accordingly, signals and power supplies for contacts 1350 can be arranged in a rotationally symmetrical manner. For example, two power supply contacts 1850 in connector insert 1800 can be positioned 180 degrees apart. Each of the power supply contacts 1850 can be positioned at a first angle relative to a corresponding side notch 1891. Similarly, two power supply contacts 1350 in connector receptacle 1300 can be positioned 180 degrees apart. Each of the power supply contacts 1350 can be positioned at a negative of the first angle (or 180 degrees less the first angle) relative to a corresponding keying feature 1342. This can ensure that each of the two power supply contacts 1350 are aligned and mated with a corresponding one of two power supply contacts 1850 when keying features 1342 are aligned with side notches 1891. This can ensure that proper connections are formed between contacts 1850 and contacts 1350 when connector insert 1800 is mated with connector receptacle 1300.

Similarly, two signal contacts 1850 in connector insert 1800 can be positioned 180 degrees apart. Each of the two signal contacts 1850 can be positioned at a second angle relative to a corresponding side notch 1891. Similarly, two signal contacts 1350 in connector receptacle 1300 can be positioned 180 degrees apart. Each of the signal contacts 1350 can be positioned at a negative of the second angle (or 180 degrees less the second angle) relative to a corresponding keying feature 1342. This can ensure that each of the two signal contacts 1350 are aligned and mated with a corresponding one of two signal contacts 1850 when keying features 1342 are aligned with side notches 1891.

The two signal contacts 1850 in connector insert 1800 can convey the same signal, they can convey signals that are interchangeable by their nature, or that can be made interchangeable by the addition of circuitry such as multiplexers. For example, the two signal contacts 1850 can convey corresponding sides of two differential pair signals, where the two differential pairs are interchangeable. The two signal contacts can convey two different signals, where the two different signals can be identified and routed as needed through switching circuits after insertion of connector insert 1800 into connector receptacle 1300.

Figure 18C:
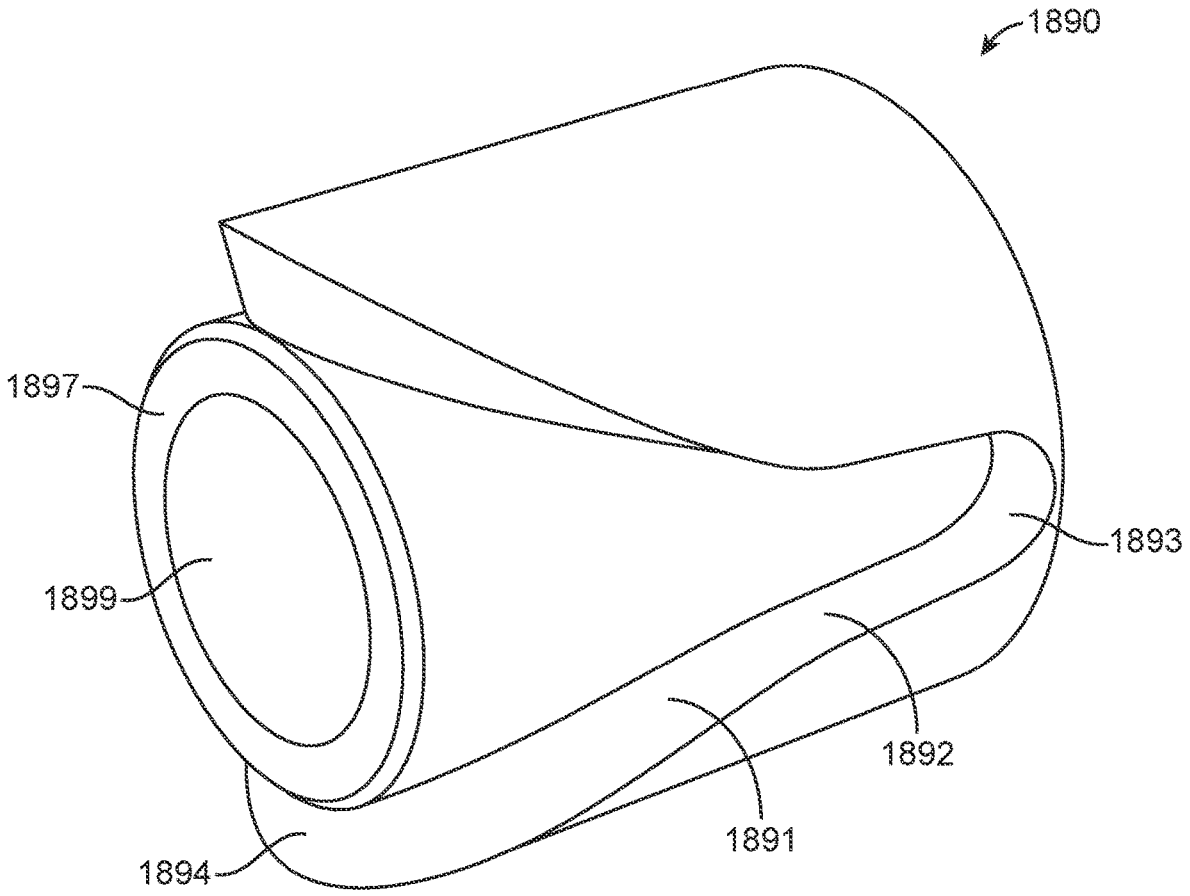
FIG. 18C illustrates a cam having keying features according to an embodiment of the present invention.

FIG. 18C illustrates a cam having keying features according to an embodiment of the present invention. Cam 1890 can include passage 1899 in shaft 1897 for connect-detect contact 1860 (shown in FIG. 18B.) Cam 1890 can further include keying features formed as curved front surface 1894 and side notches 1891. Side notches 1891 can each include sides 1892 and bottom 1893. As connector insert 1800 is mated with connector receptacle 1300 (shown in FIG. 13), keying features 1342 (shown in FIG. 13) can engage cam 1890. For example, keying features 1342 can engage curved front surface 1894. Further insertion by a user can tend to rotate connector insert 1800 such that keying features 1342 engage sides 1892 of side notches 1891. Further rotation and insertion of connector insert 1800 can move keying features 1342 along sides 1892. Further insertion can be relatively straight or non-rotational and can align keying features 1342 in side notches 1891 such that keying features 1342 reach or approach bottoms 1893 of side notches 1891. During some insertions, keying features 1342 can avoid curved front surface 1894 and engage sides 1892 of side notches 1891. After some initial rotation, further insertion can be relatively straight or non-rotational and keying features 1342 can reach or approach bottoms 1893 of side notches 1891. During some insertions, keying features 1342 and side notches can be aligned such that after a non-rotational insertion, keying features 1342 can reach or approach bottoms 1893 of side notches 1891.

Figure 19:
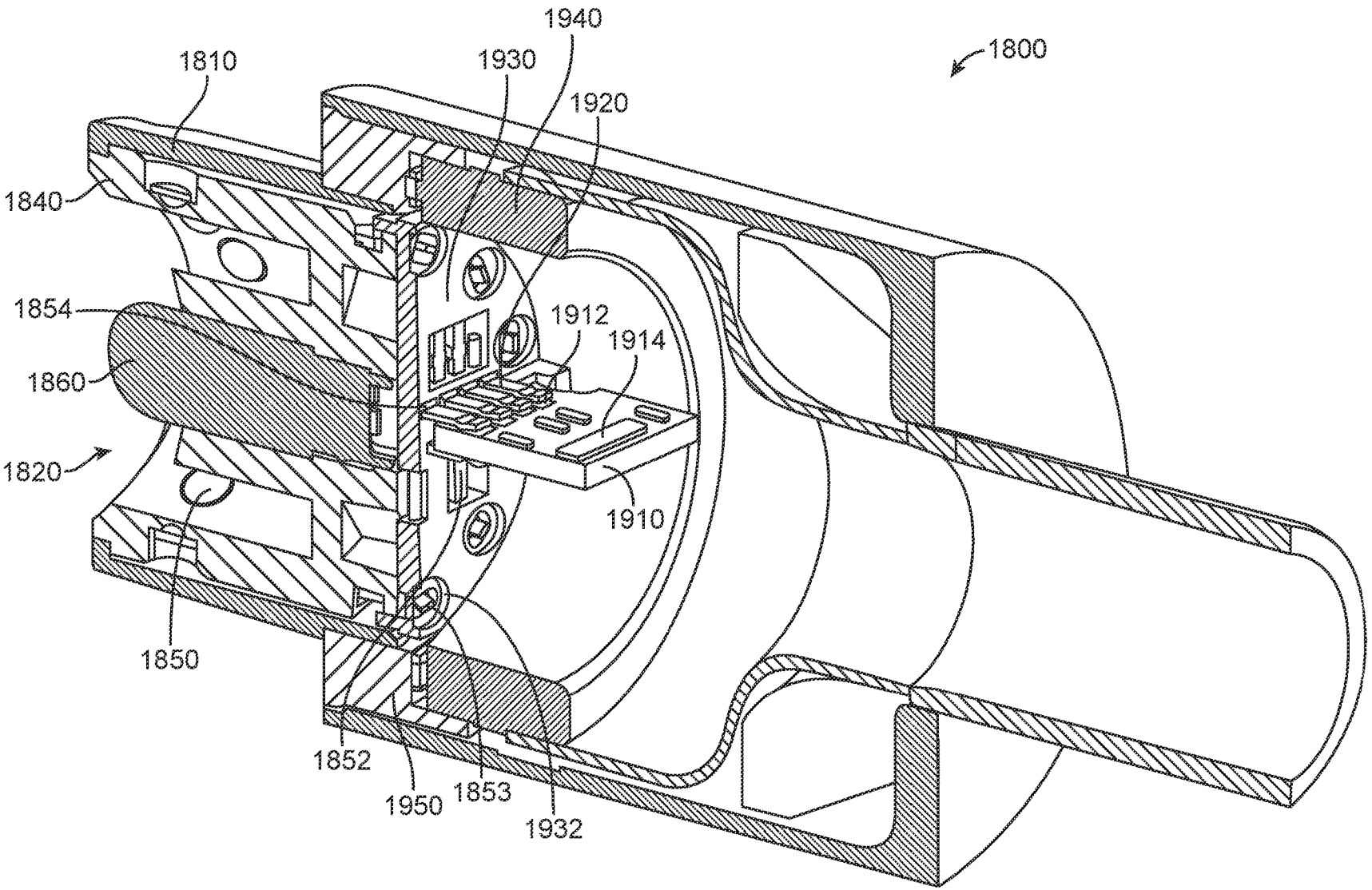
FIG. 19 illustrates a cross-section view of the connector insert of FIG. 18A.

FIG. 19 illustrates a cutaway side view of the connector insert of FIG. 18A. Connector insert 1800 can include ground contact 1810 around housing 1840. Contacts 1850 can be supported by housing 1840. Ground contact 1810 and housing 1840 can define recess 1820. Connect-detect contact 1860 can be located in recess 1820. Contacts 1850 can be soldered to contact bodies 1852 at ends 1853. Ends 1853 can be exposed in openings 1932 of interposer 1930. Contact bodies 1852 can terminate at end 1854, which can be soldered to surface-mount contact 1920. Surface-mount contacts 1920 can be soldered to pads 1912 on board 1910. Board 1910 can further include pads 1914. Conduits and a cable (not shown) can be soldered to pads 1914. Shield 1940 can provide shielding for signals on surface-mount contacts 1920. Shield 1940 can be formed of ferro-magnetic material that can be attracted to magnet 1730 and magnet 1740 in connector receptacle 1300 (shown in FIG. 21.) Board 1910 can further support various electronic circuits and components. Ground ring 1950 can further shield board 1910.

In this configuration, contacts 1850 can extend in a connection direction into connector insert 1800. They can then be connected to contact bodies 1852, which can be supported by interposer 1930. That is, interposer 1930 can be insert molded around contact bodies 1852. Board 1910 can be connected to interposer 1930 through surface-mount contacts 1920. This arrangement can provide a connector insert having a low profile. That is, this arrangement can provide connector insert 1800 with a short distance from contact bodies 1852 to pads 1914 on board 1910.

Figure 20:
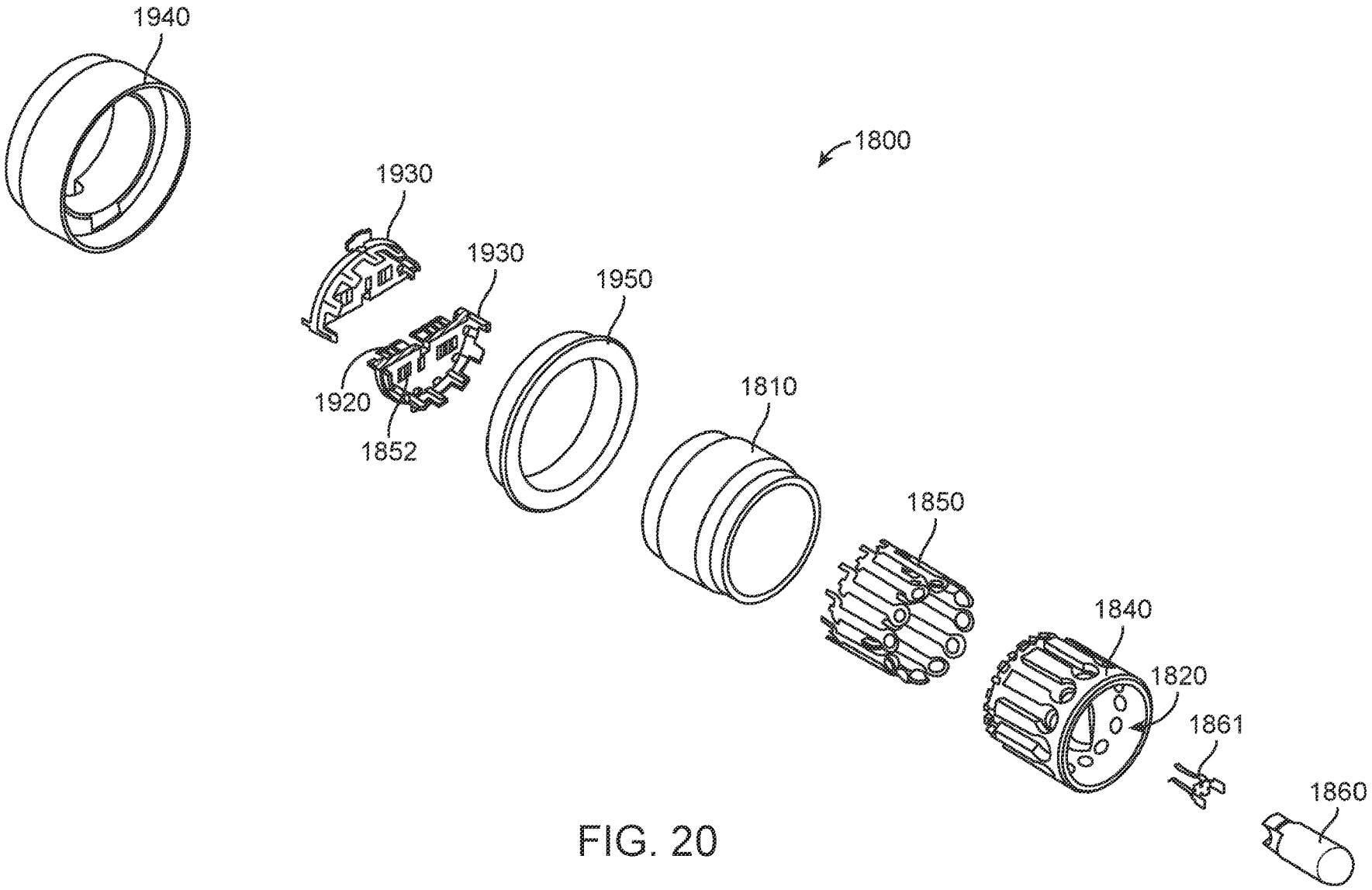
FIG. 20 is an exploded view of the connector insert of FIG. 18A.

FIG. 20 is an exploded view of the connector insert of FIG. 18A. Connector insert 1800 can include housing 1840 forming recess 1820. Contacts 1850 can be supported by housing 1840. Housing 1840 can be located in ground contact 1810. Ground ring 1950 and shield 1940 can provide shielding for signals conveyed by connector insert 1800. Shield 1940 can be formed of ferro-magnetic material that can be attracted to magnet 1730 and magnet 1740 in connector receptacle 1300 (shown in FIG. 21.) The signals can be conveyed by contacts 1850, contact bodies 1852, and surface-mount contacts 1920. Connect-detect contact 1860 can connect to contact portions 1861, and can be located in recess 1820 of connector insert 1800. Contact bodies 1852 can be supported by interposer 1930, which can be formed of one portion or two portions, as shown. For example, one or more portions of interposer 1930 can be molded around contact bodies 1852.

Figure 21:
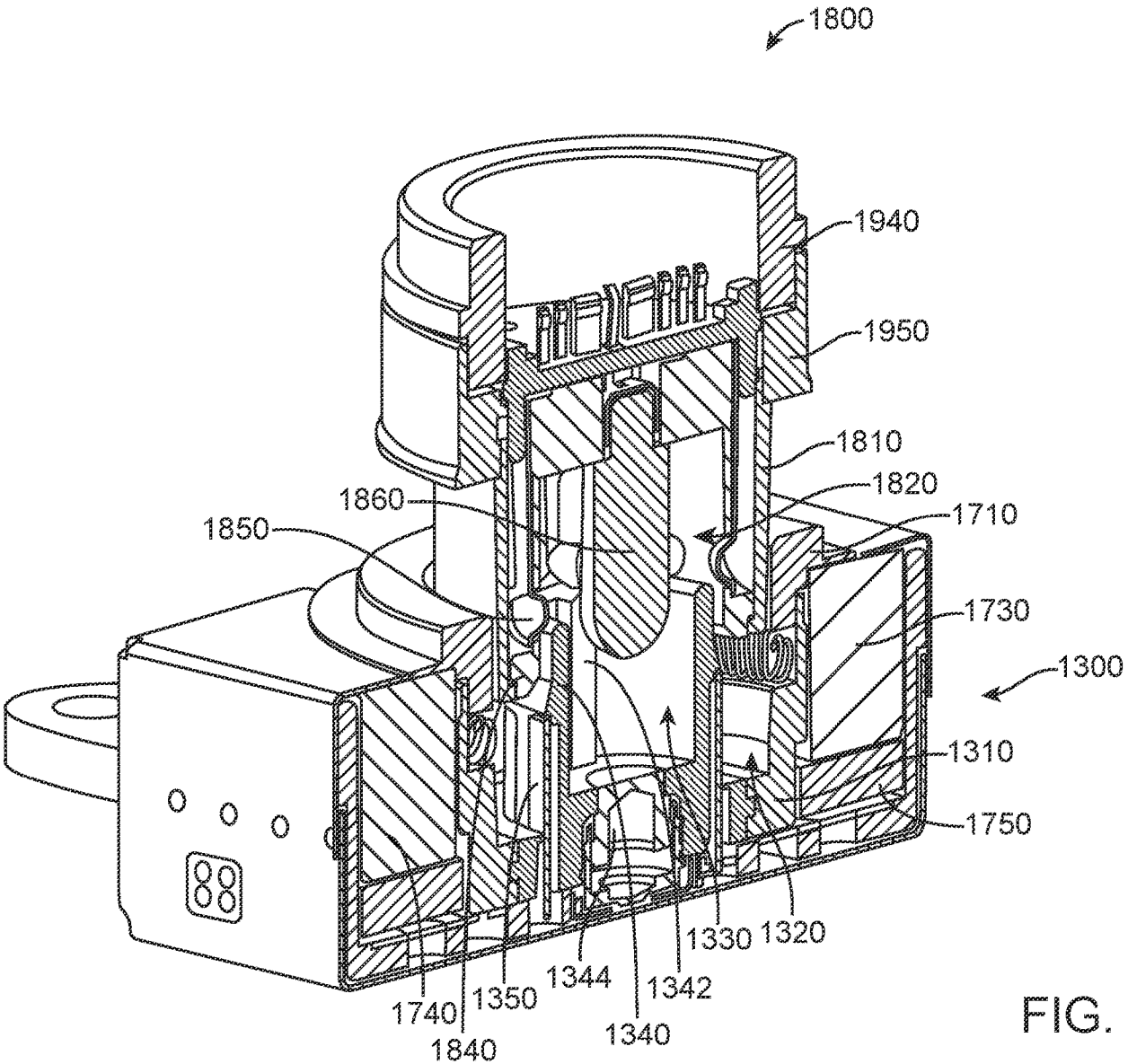
FIG. 21 illustrates a partial mating of a connector insert and a connector receptacle according to an embodiment of the present invention.

FIG. 21 illustrates a partial mating of a connector insert and a connector receptacle according to an embodiment of the present invention. In this example, connector insert 1800 is being mated with connector receptacle 1300. Magnets and magnetically conductive structures in connector insert 1800 and connector receptacle 1300 can guide an insertion of connector insert 1800 into connector receptacle 1300. These magnets and magnetically conductive structures can help to pull connector insert 1800 into connector receptacle 1300 and can help connector insert 1800 to rotationally align to connector receptacle 1300.

For example, connector receptacle 1300 can include a magnet 1730, magnet 1740, and backplate 1750. Flux from magnet 1730 and magnet 1740 can be guided by trim ring 1710. Trim ring 1710 can be formed of a ferromagnetic material. This flux can be guided to attract ferromagnetic ground ring 1950 in connector insert 1800. This attraction can help pull connector insert 1800 into connector receptacle 1300. Trim ring 1710 can include magnetic alignment features to direct magnetic field lines between magnet 1730 and shield 1940, as well as between magnet 1740 and shield 1940. These magnetic alignment features can help guide connector insert 1800 into connector receptacle 1300. This can help to align keying features, such as side notches 1891, on cam 1890 (both shown in FIG. 18C) in connector insert 1800 with keying features 1342 in connector receptacle 1300. Ground contact 1810 of connector insert 1800 and ground ring 1310 of connector receptacle 1300 can be formed of a non-ferromagnetic material. This can further help to channel flux from trim ring 1710 of connector receptacle 1300 to ground ring 1950 and shield 1940 of connector insert 1800.

During mating, ground contact 1810, housing 1840, and contacts 1850 of connector insert 1800 can fit in first recess 1320 in connector receptacle 1300. Connect-detect contact 1860 can fit in second recess 1330 of connector receptacle 1300. Contacts 1350 and housing 1340 of connector receptacle 1300 can fit in recess 1820 in connector insert 1800. Once mated, contacts 1850 on housing 1840 of connector insert 1800 can mate with contacts 1350 on housing 1340 of connector receptacle 1300 to form paths for signals, as well as one or more power supplies, grounds, or other voltages. Connect-detect contact 1860 can physically and electrically connect to connect-detect contact 1344 in connector receptacle 1300.

Either or both connect-detect contact 1860 and connect-detect contact 1344 can be a spring-biased contact. For example, connect-detect contact 1344 can be a spring-biased contact. In this case, connect-detect contact 1344 can be compressed as connector insert 1800 if fully inserted into connector receptacle 1300. This configuration can allow power, signals, or both to be withheld from contacts 1850 in connector insert 1800 (and contacts 1350 in connector receptacle 1300) until a connection between connector insert 1800 and connector receptacle 1300 is detected by the formation of an electrical path through connect-detect contact 1344 and connect-detect contact 1860. This can help to reduce or eliminate arcing between signal, power supply, or ground contacts included in contacts 1350 in connector receptacle 1300 and contacts 1850 in connector insert 1800.

Either or both connector insert 1800 and connector receptacle 1300 can include one or more magnets. These magnets can have field lines in various orientations in order to improve the attraction of connector insert 1800 to connector receptacle 1300. An example is shown in the following figure.

Figure 22:
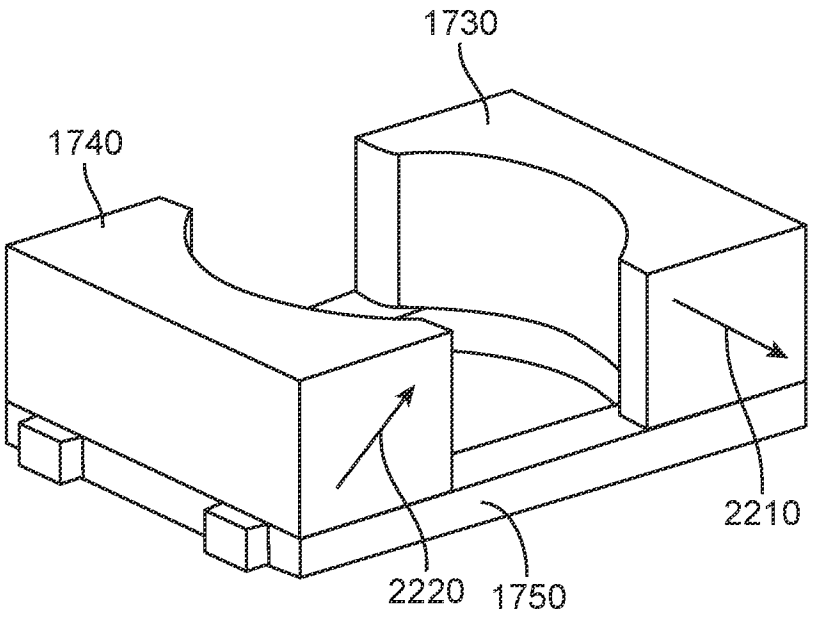
FIG. 22 illustrates a magnetic structure that can be used in a connector receptacle according to an embodiment of the present invention.

FIG. 22 illustrates a magnetic structure that can be used in a connector receptacle according to an embodiment of the present invention. Magnet 1730 and magnet 1740 can have field lines 2210 and field lines 2220, respectively. These field lines can be angled to further guide flux from magnet 1730 and magnet 1740 to connector insert 1800. Magnet 1730 and magnet 1740 can be attached to or otherwise adjacent to backplate 1750.

Again, trim ring 1710 in connector receptacle 1300 (both shown in FIG. 13) and ground ring 1950 in connector insert 1800 (both shown in FIG. 18A) can include various features to help further direct field lines. For example, trim ring 1710 can include cavities or cutouts 2310 (shown in FIG. 23.) An example is shown in the following figures.

Figure 23:
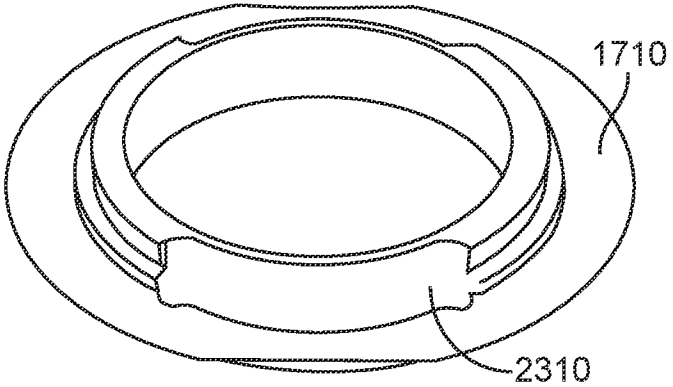
FIG. 23 illustrates a trim ring for a connector receptacle according to an embodiment of the present invention.

FIG. 23 illustrates a trim ring for a connector receptacle according to an embodiment of the present invention. Cavities or cutouts 2310 in trim ring 1710 can provide magnetic alignment features to help to guide field lines to improve the mating of connector insert 1800 to connector receptacle 1300 (both shown in FIG. 21.) That is, the field lines can be directed such that they can attract connector insert 1800 to connector receptacle 1300. The field lines can also help to laterally align connector insert 1800 with connector receptacle 1300. This can position keying features, such as side notches 1891, on cam 1890 (both shown in FIG. 18C) of connector insert 1800 for mating with keying features 1342 (shown in FIG. 21) of connector receptacle 1300. The proper alignment of side notches 1891 on cam 1890 of connector insert 1800 to keying features 1342 of connector receptacles 1300 can help to ensure that the correct contacts 1850 (shown in FIG. 21) in connector insert 1800 align to the correct contacts 1350 (shown in FIG. 21) in connector receptacle 1300.

Figure 24:
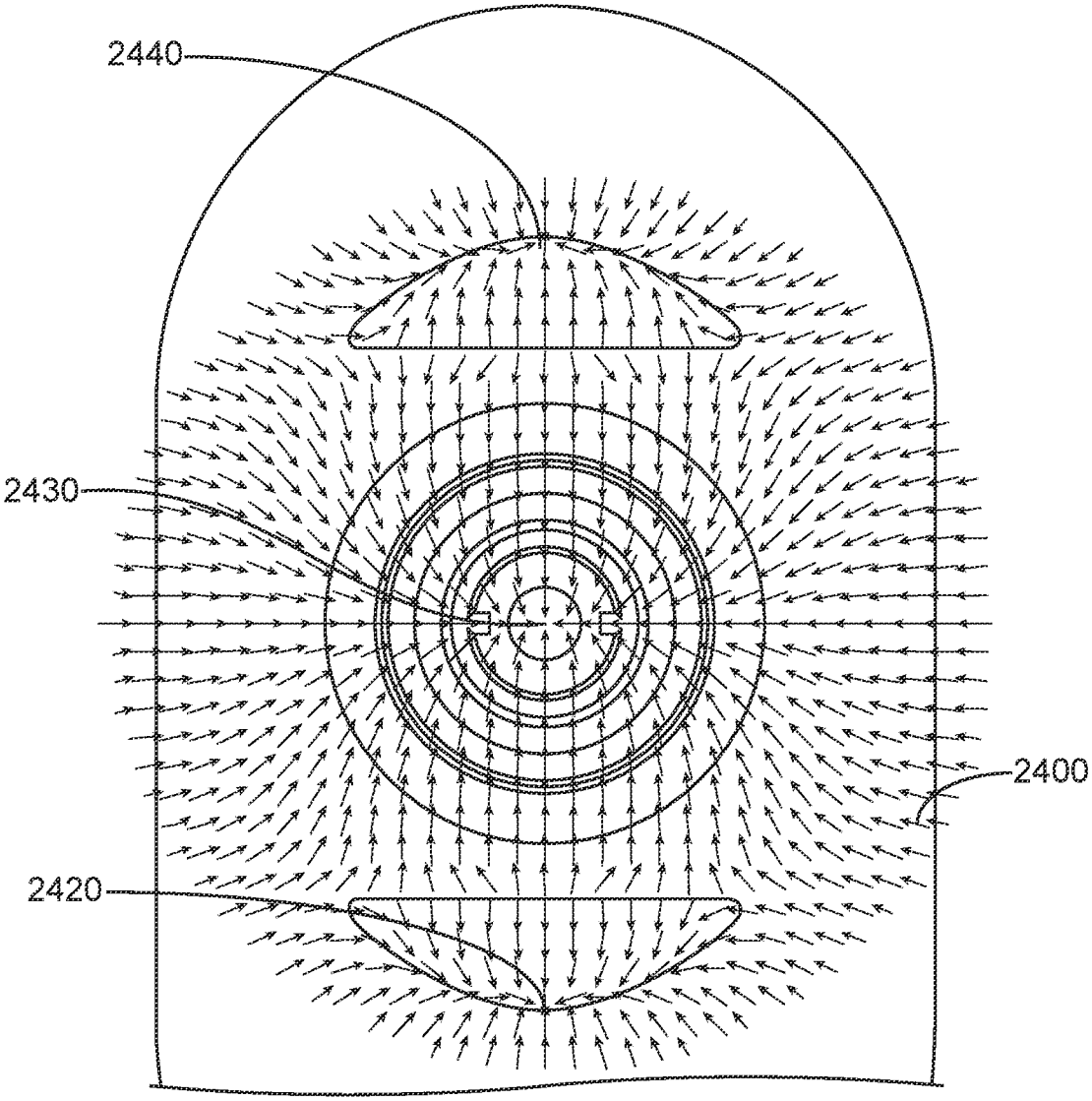
FIG. 24 illustrates a magnetic field for a power connector system according to an embodiment of the present invention.

FIG. 24 illustrates a magnetic field for a power connector system according to an embodiment of the present invention. Cavities or cutouts 2310 on trim ring 1710 (shown in FIG. 23) can be positioned near locations 2430. This can help to increase a magnetic field 2400 near locations 2430 while decreasing a magnetic field in region 2420 and region 2440. This can help to align connector insert 1800 to connector receptacle 1300 (shown in FIG. 21.)

Figure 25:
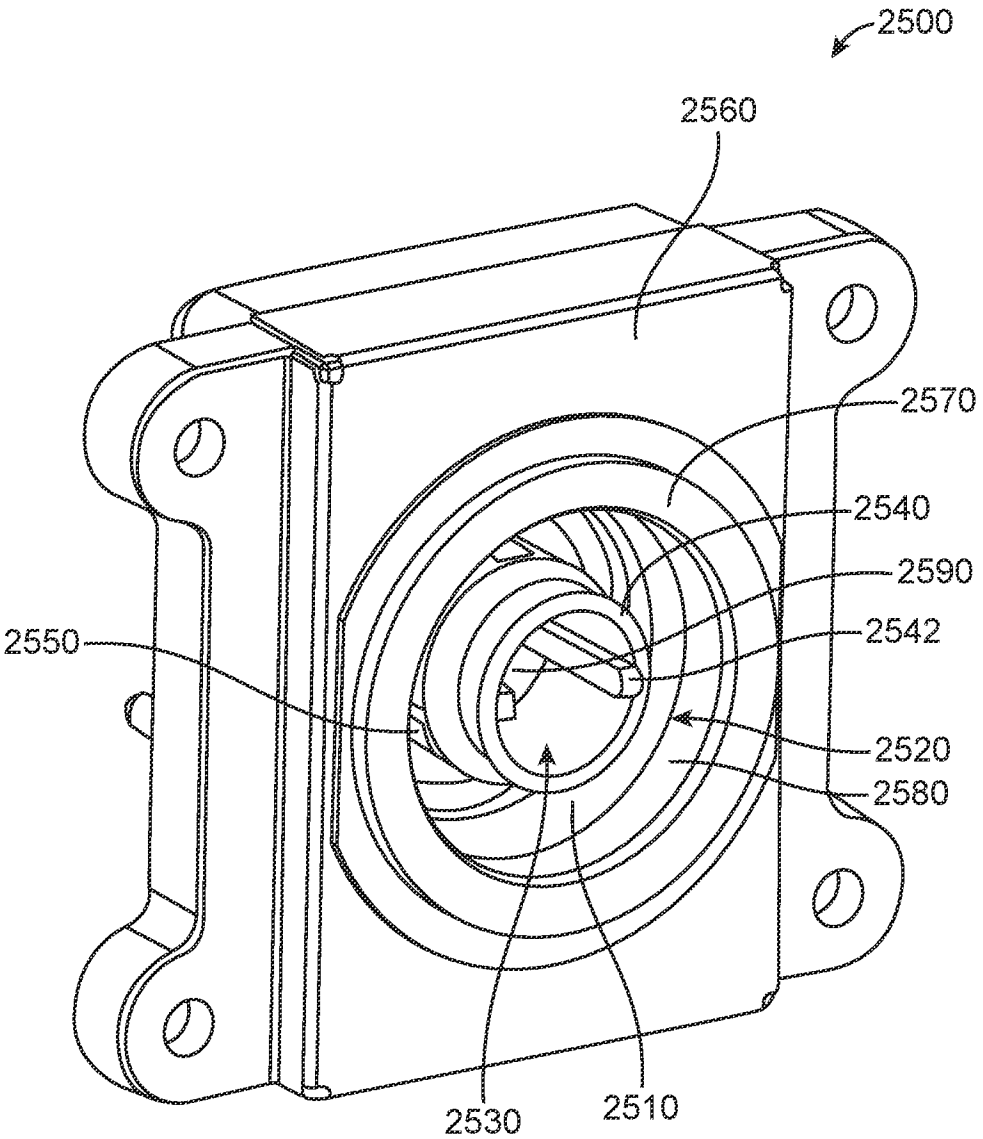
FIG. 25 illustrates another connector receptacle according to an embodiment of the present invention.

FIG. 25 illustrates another connector receptacle according to an embodiment of the present invention. Connector receptacle 2500 can be used as connector receptacle 200 in FIG. 1 or as a connector receptacle in these and other embodiments of the present invention. Connector receptacle 2500 can include trim ring 2570 and ground contact 2510 surrounding housing 2540. Housing 2540 can support contacts 2550. Contacts 2550 can convey signals, one or more power supplies, ground, or other currents or voltages of interest. Trim ring 2570 and ground contact 2510 can define first recess 2520. Housing 2540 can surround second recess 2530. Connect-detect contact 2590 can be located in second recess 2530. Keying features 2542 can be located in second recess 2530 on housing 2540. Ground contact 2510 can be attached to front shield 2560 and trim ring 2570. Canted spring 2580 can be located in first recess 2520. Ground contact 2510 can convey a ground, through in these and other embodiments of the present invention, ground contact 2510 can convey a power supply voltage or other voltage.

Figure 26:
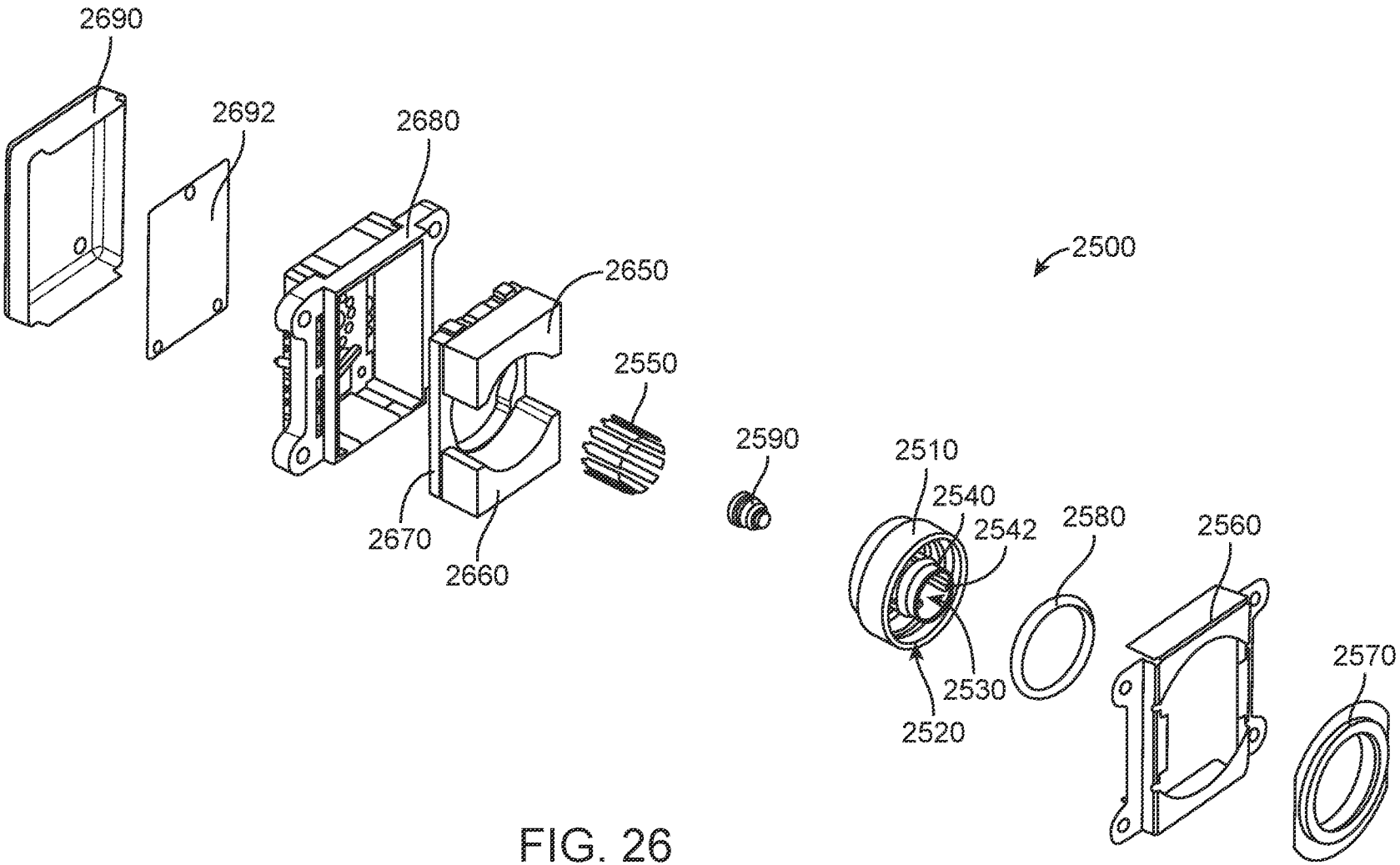
FIG. 26 is an exploded view of the connector receptacle of FIG. 25.

FIG. 26 is an exploded view of the connector receptacle of FIG. 25. Connector receptacle 2500 can include ground contact 2510. Ground contact 2510 can be attached to front shield 2560 and trim ring 2570. Canted spring 2580 can be located in a groove formed between ground contact 2510 and trim ring 2570. Housing 2540 can include keying features 2542 and can form second recess 2530. Connect-detect contact 2590 can be located in second recess 2530. Contacts 2550 can be supported by housing 2540 and can be available in first recess 2520. Magnet 2650 and magnet 2660 can be laterally placed on sides of ground contact 2510. Magnet 2650 and magnet 2660 can be supported by backplate 2670. Housing 2680 can support magnet 2650, magnet 2660, backplate 2670, and ground contact 2510. Tape layer 2692 can attach shield 2690 to a backside of housing 2680.

Figure 27:
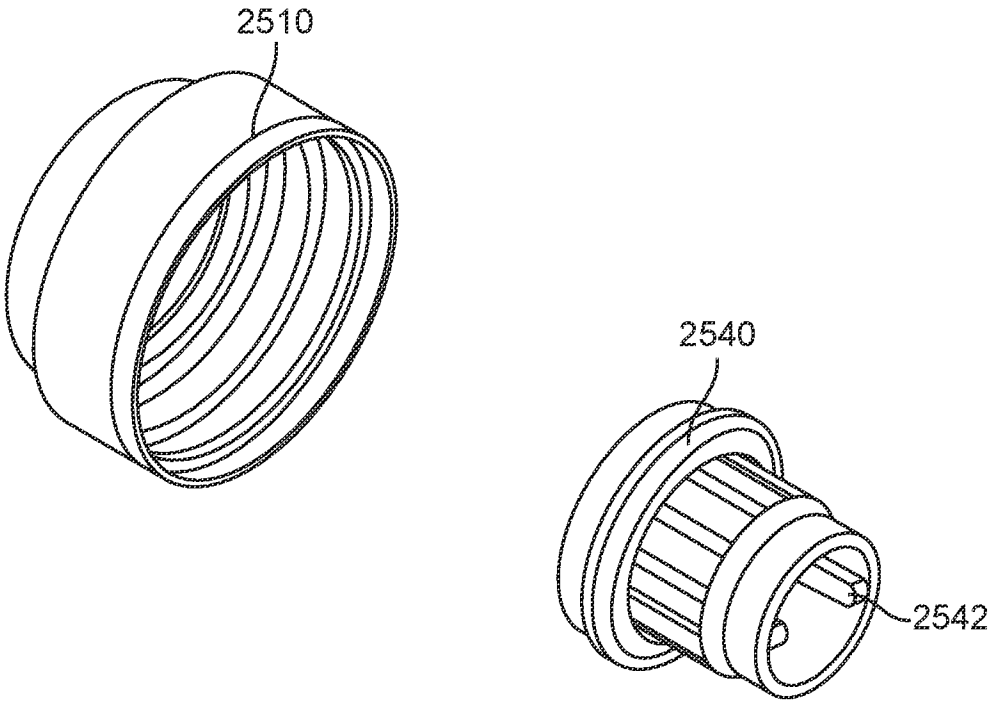
FIG. 27 illustrates a portion of the connector receptacle of FIG. 25.

FIG. 27 illustrates a portion of the connector receptacle FIG. 25. Housing 2540 can include keying features 2542 and be supported in ground contact 2510.

Figure 28:
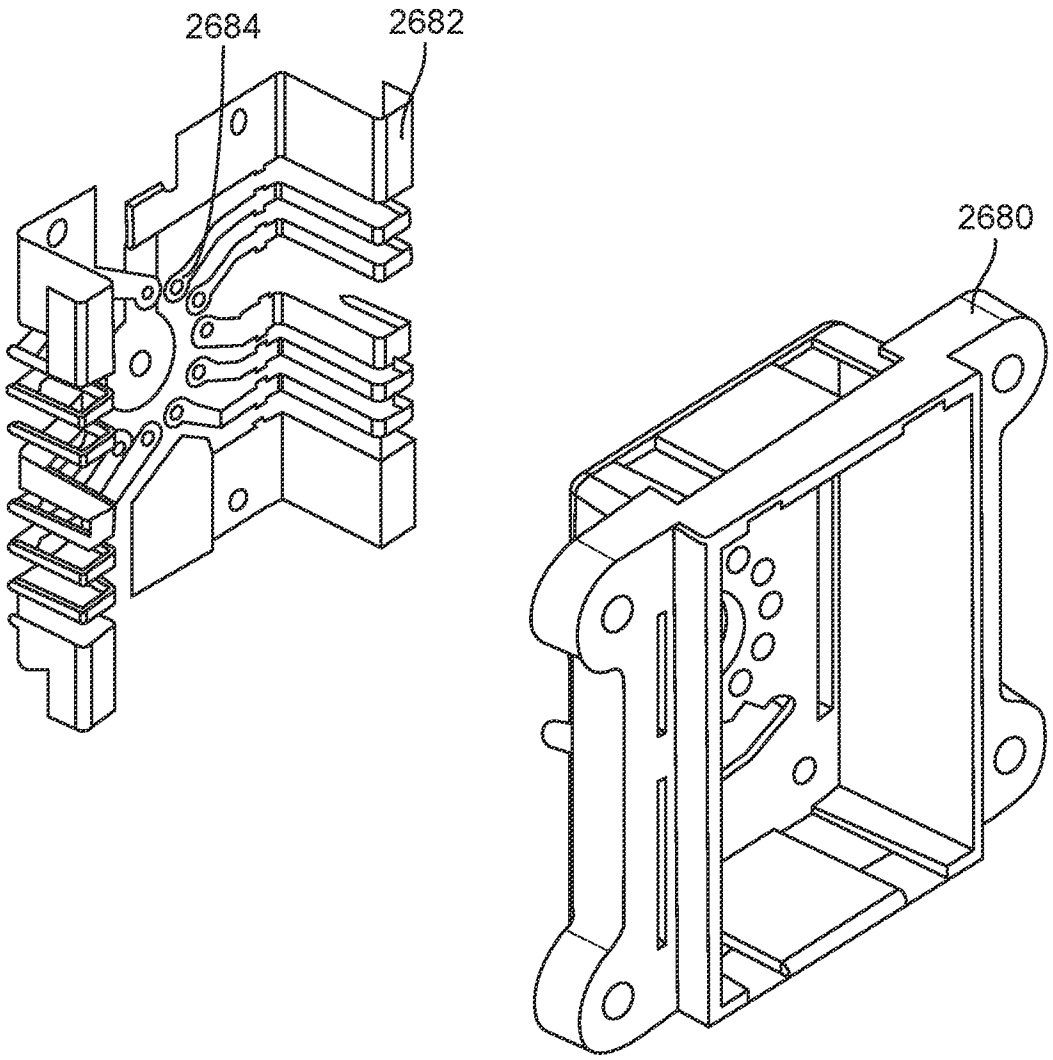
FIG. 28 illustrates a portion of the connector receptacle of FIG. 25.

FIG. 28 illustrates a lead frame and housing for the connector receptacle of FIG. 25. In this example, lead frame 2682 can be supported by housing 2680. For example, housing 2680 can be formed around portions of lead frame 2682 using injection molding or other technique. Contacts 2550 (shown in FIG. 26) can be soldered to locations 2684 on lead frame 2682.

Figure 29A:
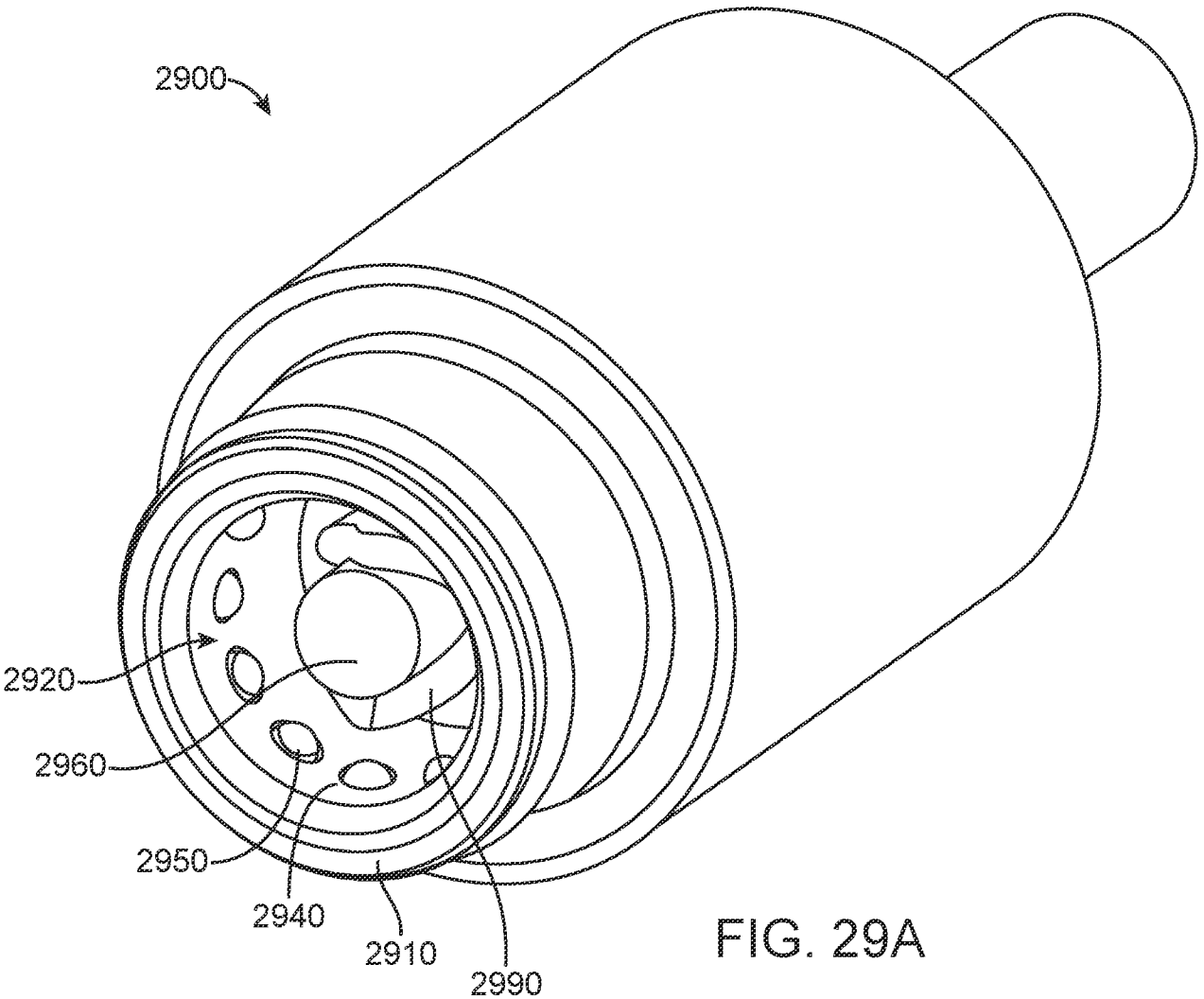
FIG. 29A illustrates a connector insert according to an embodiment of the present invention.

FIG. 29A illustrates a connector insert according to an embodiment of the present invention. Connector insert 2900 can include ground contact 2910. Ground contact 2910 can support housing 2940. Housing 2940 can support contacts 2950. Contacts 2950 can convey signals, one or more power supplies, grounds, or other currents or voltages of interest. Housing 2940 can define recess 2920. Connect-detect contact 2960 can be located in recess 2920. Cam 2990 can be positioned around connect-detect contact 2960. Ground contact 2910 can convey a ground, through in these and other embodiments of the present invention, ground contact 2910 can convey a power supply voltage or other voltage.

Figure 29B:
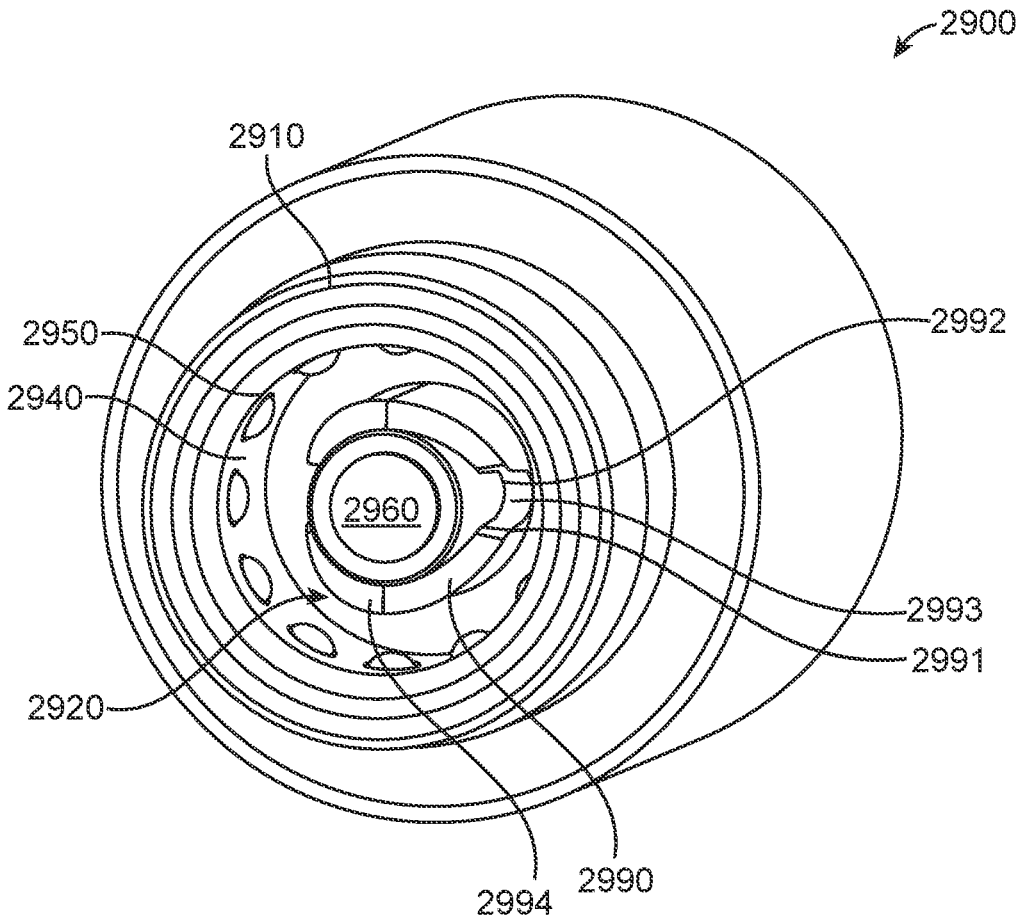
FIG. 29B illustrates another view of a connector insert according to an embodiment of the present invention.

FIG. 29B illustrates another view of a connector insert according to an embodiment of the present invention. As before, connector insert 2900 can include ground contact 2910 around housing 2940. Housing 2940 can support contacts 2950. Contacts 2950 can convey signals, one or more power supplies, grounds, or other currents or voltages of interest. Housing 2940 can define recess 2920. Connect-detect contact 2960 can be located in recess 2920. Cam 2990 can be located around connect-detect contact 2960.

When connector insert 2900 is mated with a corresponding connector receptacle, such as connector receptacle 2500 (shown in FIG. 25), corresponding contacts 2950 in connector insert 2900 can align with corresponding contacts 2550 (shown in FIG. 25) in connector receptacle 2500. That is, a contact 2950 to convey a power supply can rotationally align and mate with a corresponding contact 2550 to convey the power supply. Similarly, a contact 2950 to convey a first signal can rotationally align and mate with a corresponding contact 2550 to convey the first signal. But it can be difficult to rotationally align a connector insert with a corresponding connector receptacle in such a way that all contacts are properly aligned. This can be particularly true when an insertion of connector insert 2900 into connector receptacle 2500 is made on a backside of electronic device 120 (shown in FIG. 1) and out of view of a user making the insertion.

Accordingly, embodiments of the present invention can provide self-aligning features for connector insert 2900 and connector receptacle 2500 that can facilitate the insertion of connector insert 2900 into connector receptacle 2500. For example, side notches 2991 on cam 2990 of connector insert 2900 can engage keying features 2542 (shown in FIG. 25) of connector receptacle 2500. Cam 2990 can include curved front surface 2994. During insertion, when curved front surface 2994 of cam 2990 engages keying features 2542, connector insert 2900 can naturally begin to rotate in a user's hand. As the insertion continues, keying features 2542 can begin to engage a side 2992 on each of side notches 2991 of cam 2990. As insertion is complete, keying features 2542 can bottom out and reach or approach bottom 2993 of side notches 2991.

In this way, connector insert 2900 can mate with connector receptacle 2500 in either of two orientations rotationally separated by 180 degrees. As a result, each contact 2950 in connector insert 2900 can mate with one of two contacts 2550 in connector receptacle 2500, where the two contacts 2550 are opposing contacts rotationally spaced by 180 degrees. Also, each contact 2550 in connector receptacle 2500 can mate with one of two contacts 2950 in connector insert 2900, where the two contacts 2950 are opposing contacts rotationally spaced by 180 degrees.

Accordingly, signals and power supplies for contacts 2550 can be arranged in a rotationally symmetrical manner. For example, two power supply contacts 2950 in connector insert 2900 can be positioned 180 degrees apart. Each of the power supply contacts 2950 can be positioned at a first angle relative to a corresponding side notch 2991. Similarly, two power supply contacts 2550 in connector receptacle 2500 can be positioned 180 degrees apart. Each of the power supply contacts 2550 can be positioned at a negative of the first angle (or 180 degrees less the first angle) relative to a corresponding keying feature 2542. This can ensure that each of the two power supply contacts 2550 are aligned and mated with a corresponding one of two power supply contacts 2950 when keying features 2542 are aligned with side notches 2991. This can ensure that proper connections are formed between contacts 2950 and contacts 2550 when connector insert 2900 is mated with connector receptacle 2500.

Similarly, two signal contacts 2950 in connector insert 2900 can be positioned 180 degrees apart. Each of the two signal contacts 2950 can be positioned at a second angle relative to a corresponding side notch 2991. Similarly, two signal contacts 2550 in connector receptacle 2500 can be positioned 180 degrees apart. Each of the signal contacts 2550 can be positioned at a negative of the second angle (or 180 degrees less the second angle) relative to a corresponding keying feature 2542. This can ensure that each of the two signal contacts 2550 are aligned and mated with a corresponding one of two signal contacts 2950 when keying features 2542 are aligned with side notches 2991.

The two signal contacts 2950 in connector insert 2900 can convey the same signal, they can convey signals that are interchangeable by their nature, or that can be made interchangeable by the addition of circuitry such as multiplexers. For example, the two signal contacts 2950 can convey corresponding sides of two differential pair signals, where the two differential pairs are interchangeable. The two signal contacts can convey two different signals, where the two different signals can be identified and routed as needed through switching circuits after insertion of connector insert 2900 into connector receptacle 2500.

Figure 29C:
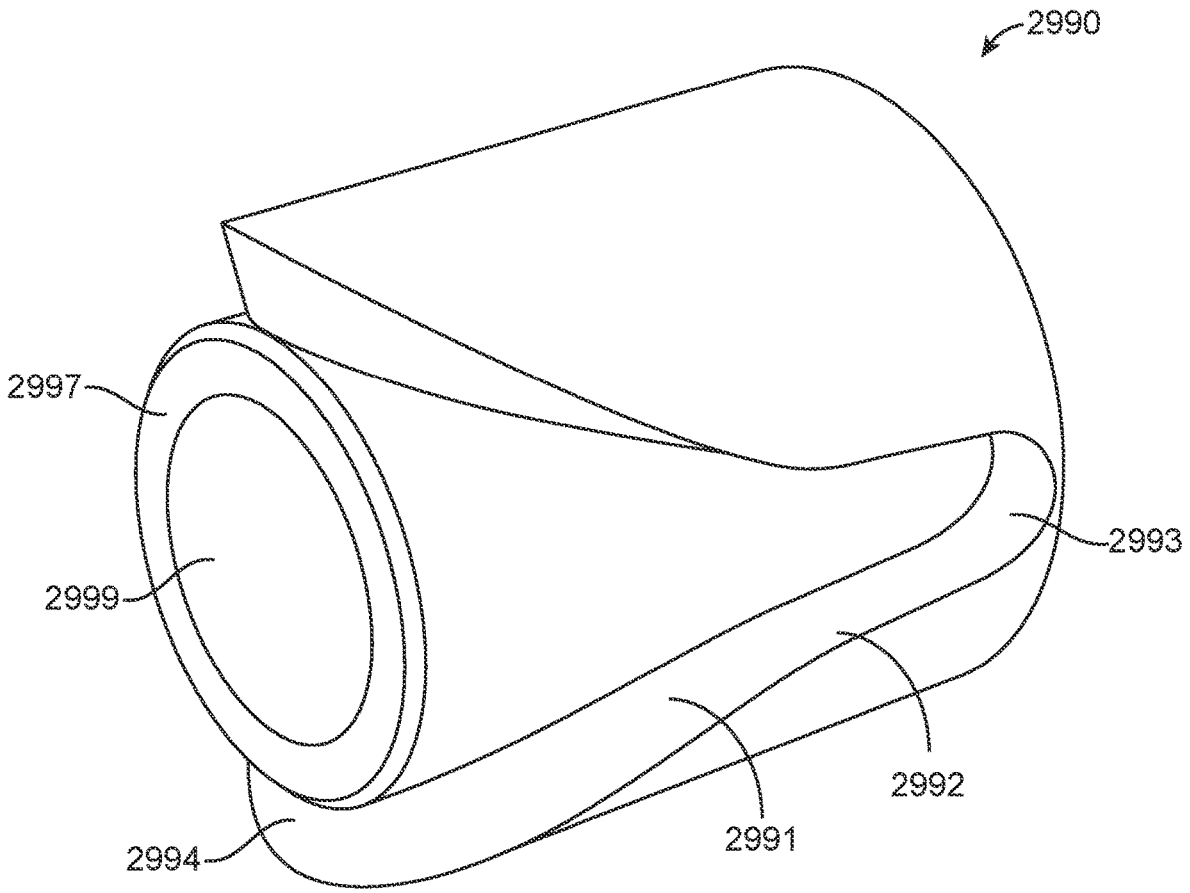
FIG. 29C illustrates a cam having keying features according to an embodiment of the present invention.

FIG. 29C illustrates a cam having keying features according to an embodiment of the present invention. Cam 2990 can include passage 2999 in shaft 2997 for connect-detect contact 2960 (shown in FIG. 29B.) Cam 2990 can further include keying features formed as curved front surface 2994 and side notches 2991. Side notches 2991 can each include sides 2992 and bottom 2993. As connector insert 2900 is mated with connector receptacle 2500 (shown in FIG. 25), keying features 2542 (shown in FIG. 25) can engage cam 2990. For example, keying features 2542 can engage curved front surface 2994. Further insertion by a user can tend to rotate connector insert 2900 such that keying features 2542 engage sides 2992 of side notches 2991. Further rotation and insertion of connector insert 2900 can move keying features 2542 along sides 2992. Further insertion can be relatively straight or non-rotational and can align keying features 2542 in side notches 2991 such that keying features 2542 reach or approach bottoms 2993 of side notches 2991. During some insertions, keying features 2542 can avoid curved front surface 2994 and engage sides 2992 of side notches 2991. After some initial rotation, further insertion can be relatively straight or non-rotational and keying features 2542 can reach or approach bottoms 2993 of side notches 2991. During some insertions, keying features 2542 and side notches can be aligned such that after a non-rotational insertion, keying features 2542 can reach or approach bottoms 2993 of side notches 2991.

Figure 30:
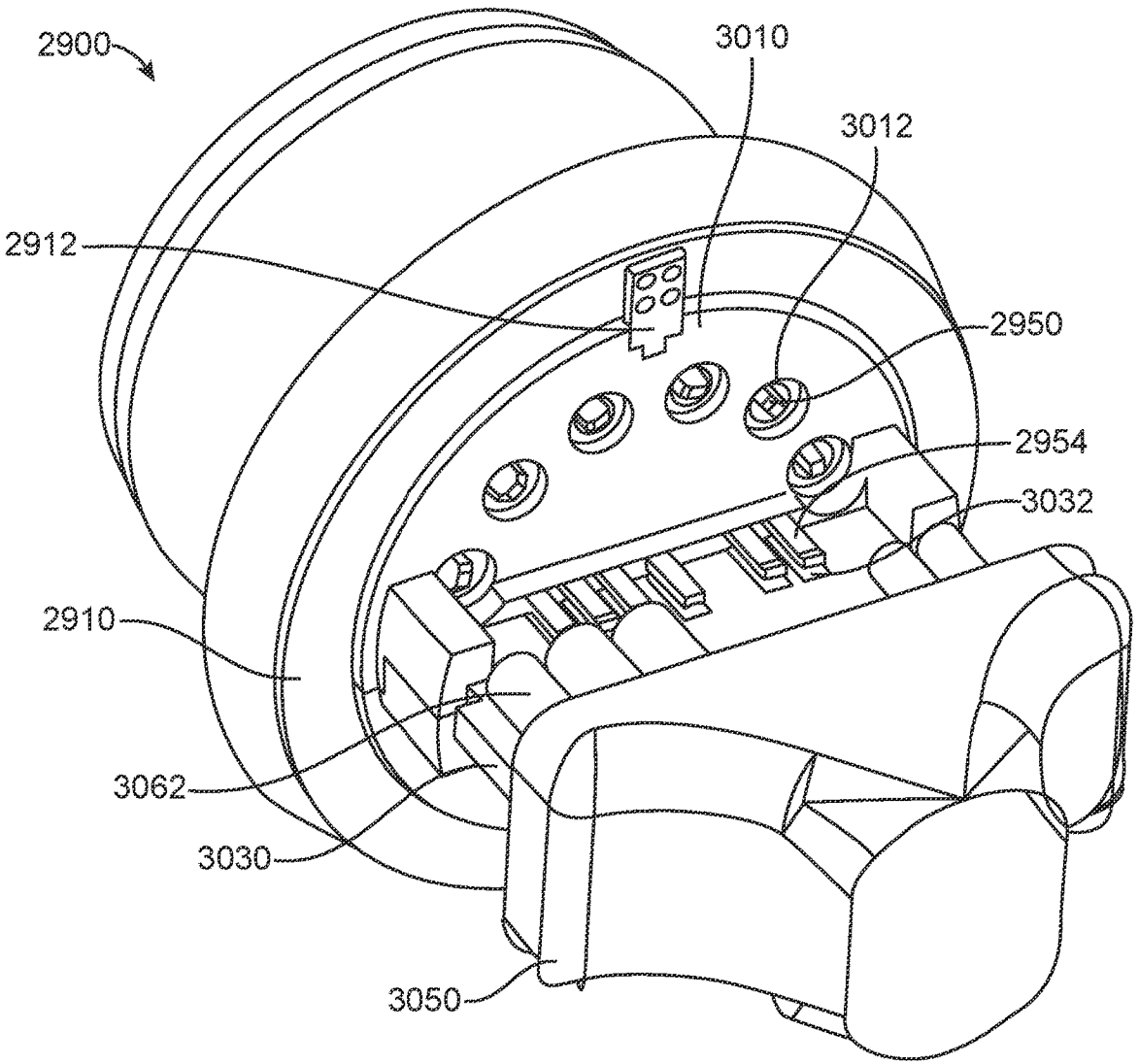
FIG. 30 illustrates a rear view of a portion of the connector insert of FIG. 29A.

FIG. 30 illustrates a rear view of a portion of the connector insert of FIG. 29A. Interposer 3010 can be located in a rear opening of ground contact 2910 of connector insert 2900. Connection 2912 can connect ground traces on interposer 3010 to ground contact 2910 and can help align interposer 3010 to ground contact 2910. Contacts 2950 can be connected to contact bodies (not shown) in opening 3012 of interposer 3010. These contact bodies can terminate in surface-mount contacts 2954. Surface-mount contacts 2954 can be soldered to pads 3032 on board 3030 as well as to interposer 3010, thereby helping to secure board 3030 to interposer 3010. Conduits in a cable (not shown) can terminate at positions 3062. These conduits can be soldered or otherwise connected to surface-mount contacts 2954. Molding 3050 can secure the conduits to each other such that connections to surface-mount contacts 2954 can be made.

Figure 31:
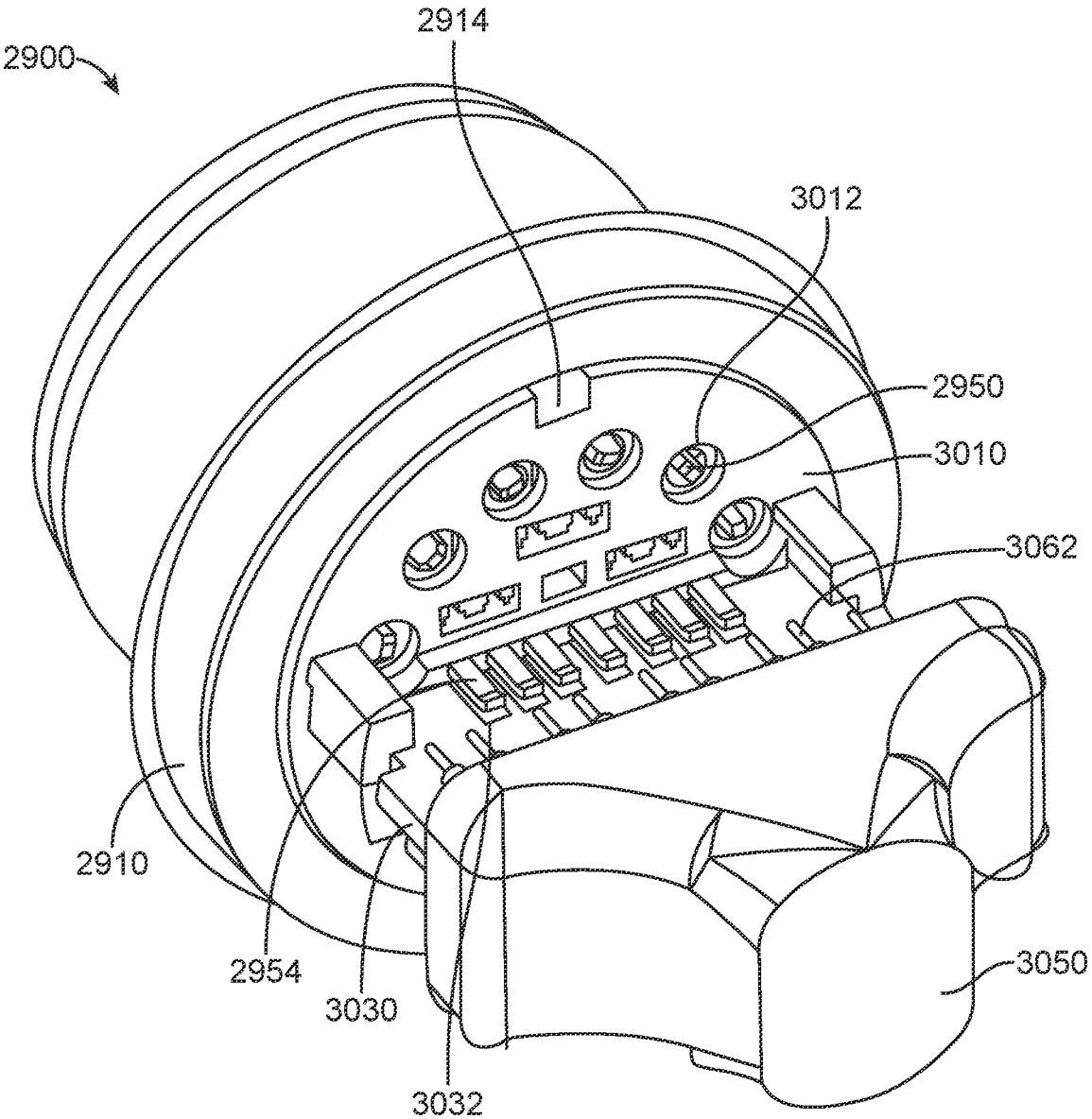
FIG. 31 illustrates a rear view of another portion of the connector insert of FIG. 29A.

FIG. 31 illustrates another rear view of a portion of the connector insert of FIG. 29A. Interposer 3010 can be located in a rear opening of ground contact 2910 of connector insert 2900. Connection 2914 can connect ground traces on interposer 3010 to ground contact 2910 and can help align interposer 3010 to ground contact 2910. Contacts 2950 can be connected to contact bodies (not shown) in opening 3012 of interposer 3010. These contact bodies can terminate in surface-mount contacts 2954. Surface-mount contacts 2954 can be soldered to pads 3032 on board 3030 as well as to interposer 3010, thereby helping to secure board 3030 to interposer 3010. Conduits in a cable (not shown) can terminate at positions 3062. These conduits can be soldered or otherwise connected to surface-mount contacts 2954. Molding 3050 can secure the conduits to each other such that connections to surface-mount contacts 2954 can be made.

Figure 32:
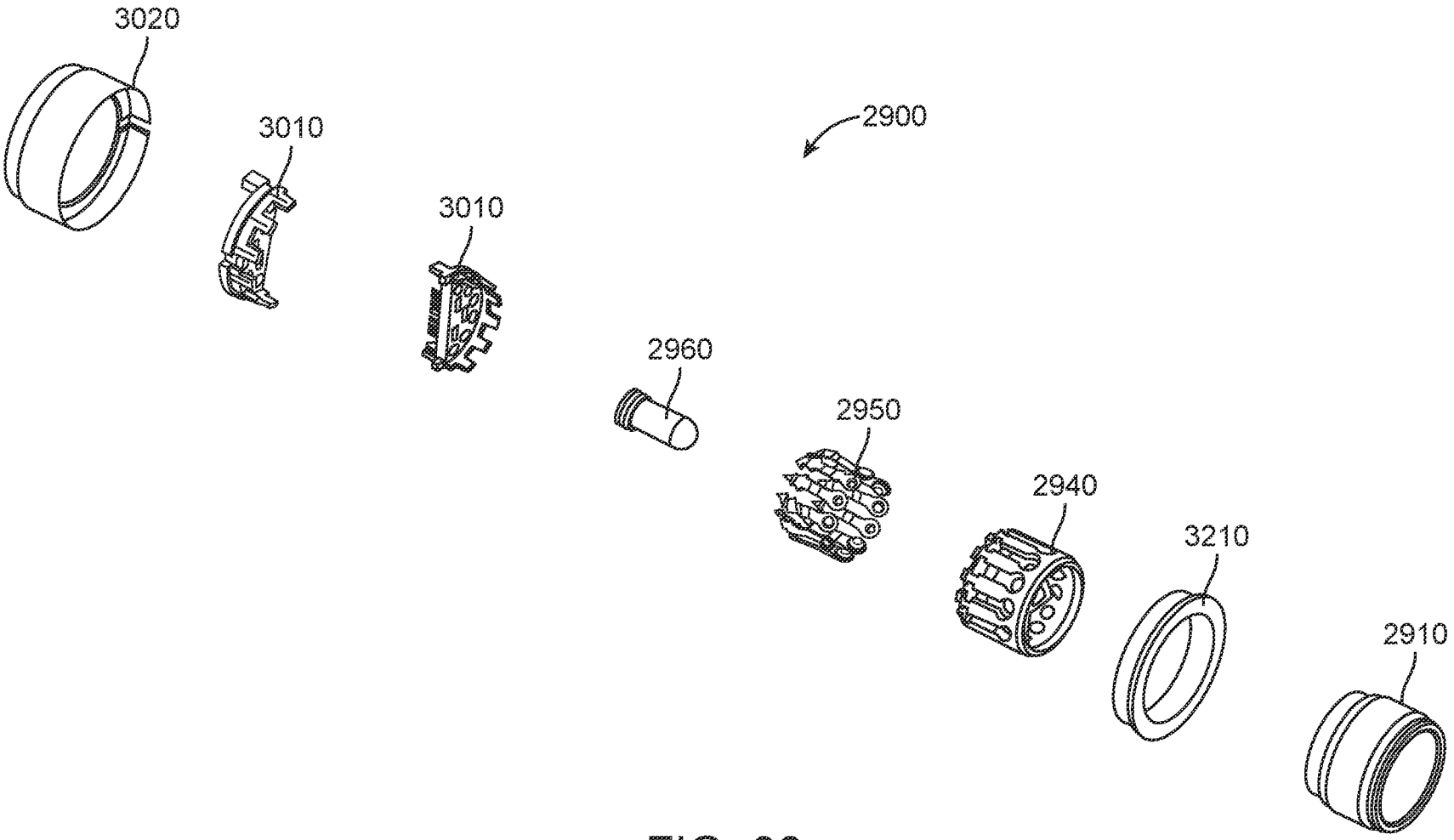
FIG. 32 is an exploded view of the connector insert of FIG. 29A.

FIG. 32 is an exploded view of the connector insert of FIG. 29A. Connector insert 2900 can include trim ring 3210 and ground contact 2910. Ground contact 2910 can support housing 2940. Housing 2940 can support contacts 2950. Connect-detect contact 2960 can be fit in housing 2940. Interposer 3010 can be formed of one or more portions and can be joined and supported by ground ring 3020.

Figure 33:
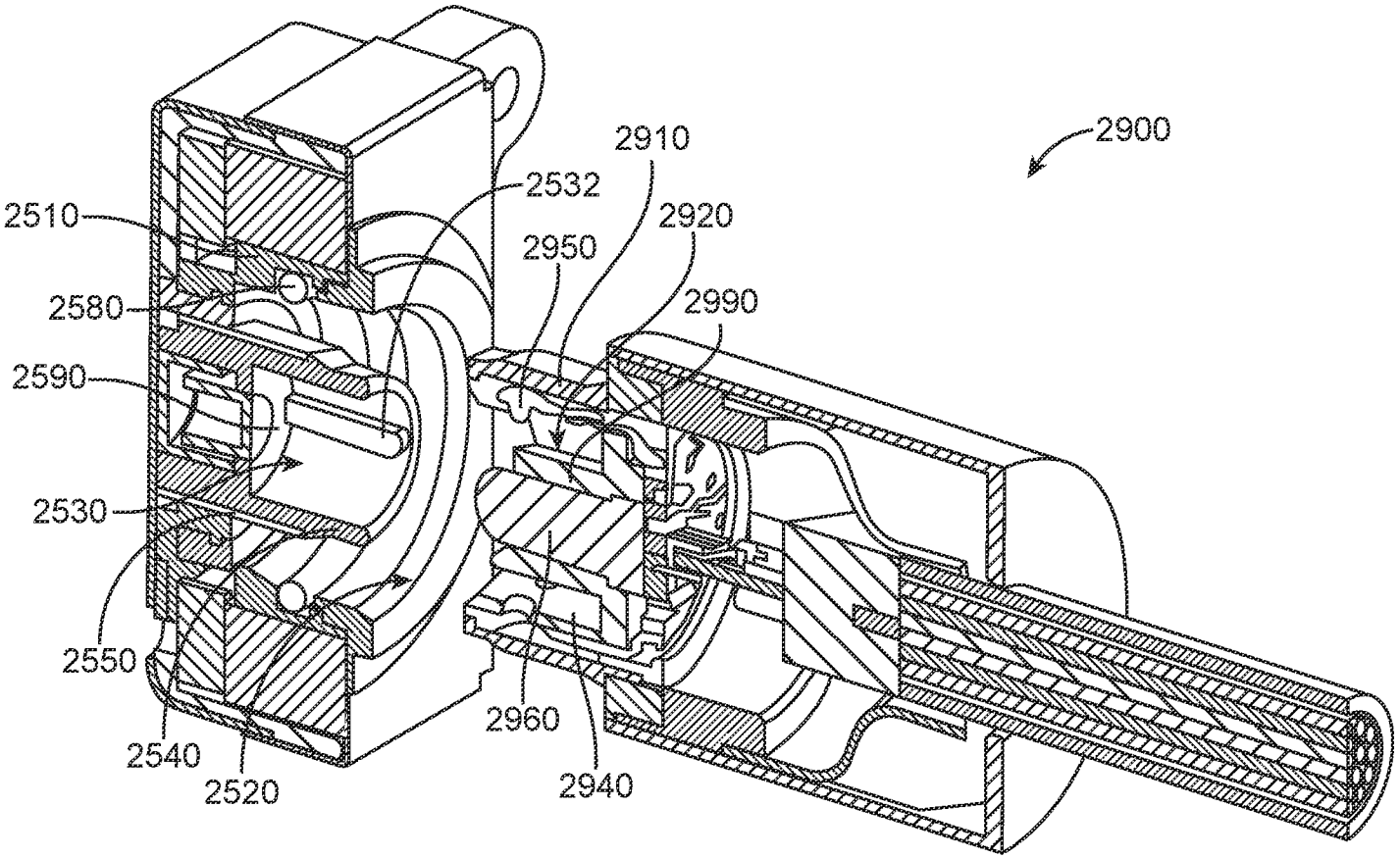
FIG. 33 illustrates a power connector system according to an embodiment of the present invention.

FIG. 33 illustrates a power connector system according to an embodiment of the present invention. In this example, connector receptacle 2500 is about to accept connector insert 2900. Connect-detect contact 2960 can fit in second recess 2530 in connector receptacle 2500. Connect-detect contact 2960 can mate with connect-detect contact 2590 in connector receptacle 2500. Housing 2940 of connector insert 2900 can fit in first recess 2520 of connector receptacle 2500. Canted spring 2580 can engage with ground contact 2910 on connector insert 2900 and ground contact 2510 on connector receptacle 2500. Contacts 2950 on housing 2940 of connector insert 2900 can mate with contacts 2550 on housing 2540 of connector receptacle 2500 to convey signals, as well as one or more power supplies, grounds, or other voltages. Ground contact 2910 can form an electrical connection with ground contact 2510. Keying features, such as side notches 2991, on cam 2990 on connector insert 2900 can engage keying features 2542 on connector receptacle 2500. Housing 2540 and contacts 2550 of connector receptacle 2500 can be inserted into recess 2920 of connector insert 2900.

Figures 34A, 34B, 34C, 34D, 34E:
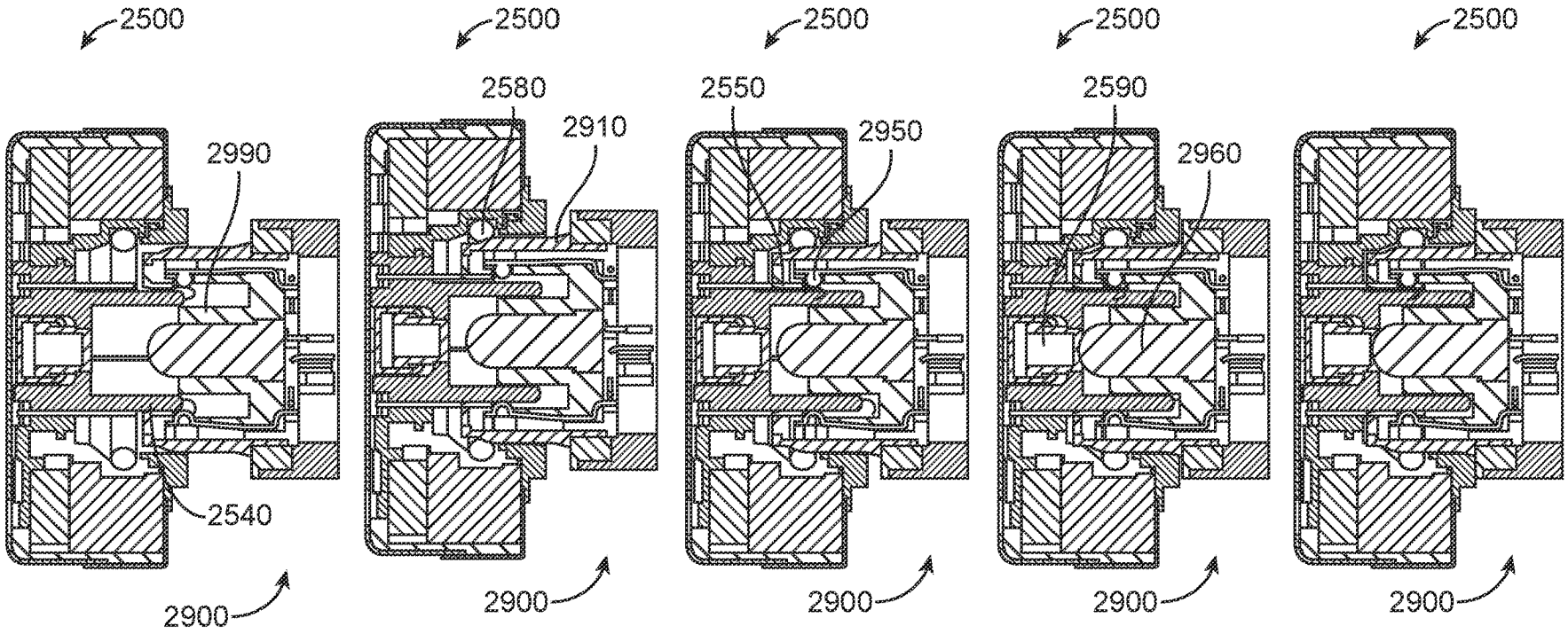
FIG. 34A through FIG. 34E illustrate a mating sequence for a power connector system according to an embodiment of the present invention.

FIG. 34A through FIG. 34E illustrate a mating sequence for a power connector system according to an embodiment of the present invention. In FIG. 34A, connector insert 2900 is about to be inserted into connector receptacle 2500. In this example, keying features 2542 can begin to engage keying features, such as side notches 2991, on cam 2990 in connector insert 2900. This can cause rotation of connector insert 2900. This rotation can help to ensure that contacts 2950 in connector insert 2900 are properly rotationally aligned with their corresponding contacts 2550 in connector receptacle 2500 (all shown in FIG. 34B.)

In FIG. 34B, canted spring 2580 can begin to engage ground contact 2910, thereby forming a connection for ground. Canted spring 2580 can further provide a tactile response to a user when the user inserts and extracts connector insert 2900 from connector receptacle 2500. Canted spring 2580 can further provide an increased retention force securing connector insert 2900 in place in connector receptacle 2500 and can operate in the same or a similar manner as canted spring 280 above.

In FIG. 34C, contacts 2950 of connector insert 2900 can begin to engage contacts 2550 of connector receptacle 2500, thereby forming electrical connections for signals, power supplies, grounds, and other voltages. In FIG. 34D, connect-detect contact 2960 can begin to engage connect-detect contact 2590. Once this connect detect connection is made, power can be applied to power contacts, which can be one or more of contacts 2950. By sequencing the application of power to the contacts 2950 after connect-detect contact 2590 engages connect-detect contact 2960, arcing between power contacts in connector insert 2900 and connector receptacle 2500 can be reduced or avoided. In FIG. 34E, connector insert 2900 can be fully mated to connector receptacle 2500.

Either or both connect-detect contact 2590 and connect-detect contact 2960 can be a spring-biased contact. For example, connect-detect contact 2590 can be a spring-biased contact. In this case, connect-detect contact 2590 can be compressed as connector insert 2900 if fully inserted into connector receptacle 2500. This configuration can allow power, signals, or both to be withheld from contacts 2950 in connector insert 2900 (and contacts 2550 in connector receptacle 2500) until a connection between connector insert 2900 and connector receptacle 2500 is detected by the formation of an electrical path through connect-detect contact 2590 and connect-detect contact 2960. This can help to reduce or eliminate arcing between signal, power supply, or ground contacts included in contacts 2550 in connector receptacle 2500 and contacts 2950 in connector insert 2900 as connector insert 2900 is mated with connector receptacle 2500.

In these and other embodiments of the present invention, flanges, shields, and other conductive portions of a power connector can be formed by stamping, forging, metal-injection molding, deep drawing, machining, micro-machining, screw-machining, 3-D printing, clinching, or other manufacturing process. The conductive portions can be formed of stainless steel, steel, copper, copper-titanium, phosphor-bronze, or other material or combination of materials. They can be plated or coated with nickel, gold, or other material. The nonconductive portions, such as housings and other structures, can be formed using insert molding, injection molding, or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials.

Embodiments of the present invention can provide power connectors including connector receptacles that can be located in various types of devices, such as such tablet computers, laptop computers, desktop computers, all-in-one computers, cell phones, storage devices, wearable-computing devices, portable media players, navigation systems, monitors, adapters, and other devices, as well as corresponding connector inserts.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A power connector system comprising:

a connector receptacle comprising:

a protrusion supporting a connect-detect contact in the center of the protrusion;

a first power contact on the protrusion; and a second power contact around the protrusion, the second power contact separate from the protrusion by a first recess; and a connector insert comprising:

a connect-detect contact; and a cylinder around the connect-detect contact, the cylinder separated from the connect-detect contact by a second recess, where an inside of the cylinder supports a first power supply contact and the cylinder further supports a second power supply contact around the connect detect contact, wherein the connector receptacle comprises keying features formed as tabs on an inside surface of a third recess in the protrusion, and the connector insert comprises a cam around the connect-detect contact, the cam comprising keying features formed as side notches.

2. The power connector system of claim 1 wherein the connector receptacle and the connector insert mate in a connection direction, and the tabs of the connector receptacle fit in the side notches of the connector insert.

3. The power connector system of claim 2 wherein the protrusion of the connector receptacle fits in the second recess of the connector insert and the cylinder of the connector insert fits in the first recess of the connector receptacle.

4. The power connector system of claim 3 wherein the connector receptacle further comprises a magnet and the connector insert comprises a ferro-magnetic ring around the cylinder.

5. The power connector system of claim 4 wherein the first power contact of the connector receptacle is a power supply contact and the second power contact of the connector receptacle is a ground contact.

6. The power connector system of claim 5 wherein the connect-detect contact in the connector insert is a spring-biased contact, and the connect-detect contact and the cam of the connector insert fit in the third recess in the protrusion of the connector receptacle.

7. The power connector system of claim 6 wherein an inside surface of the first recess of the connector receptacle comprises a circumferential groove, the connector receptacle further comprising a canted coil spring in the circumferential groove.

8. The power connector system of claim 7 further comprising a C-clip located within the canted coil spring.

9. The power connector system of claim 1 wherein the cam has a curved front surface to guide the tabs of the connector receptacle into the side notches when the connector insert is connected to the connector receptacle.

10. A connector receptacle comprising:

an annular ground ring defining a first recess;

an annular housing in the first recess, the annular housing around a second recess;

a plurality of contacts radially positioned on an outside surface of the annular housing and in the first recess;

a connect-detect contact located in the second recess; and a lead frame, wherein each of the plurality of contacts terminates in the lead frame.

11. The connector receptacle of claim 10 wherein a corresponding connector insert can be inserted into the connector receptacle in a connection direction and the lead frame is arranged to route signals from the plurality of contacts in directions orthogonal to the connection direction.

12. The connector receptacle of claim 11 further comprising a first magnet and a second magnet, each magnet on opposite sides of the first recess.

13. The connector receptacle of claim 12 wherein the annular housing further comprises keying features extending into the second recess.

14. The connector receptacle of claim 13 further comprising:

a trim ring; and a canted coil spring, wherein the trim ring is adjacent to the annular ground ring such that a dovetailed groove is formed between the trim ring and the annular ground ring, and wherein the canted coil spring is located in the dovetailed groove.

15. The connector receptacle of claim 14 further comprising a C-clip located within the canted coil spring.

16. A connector insert comprising:

an annular plug tip having an inside surface;

an annular housing adjacent to the inside surface of the annular plug tip and defining a recess, the annular housing comprising a plurality of openings;

a plurality of contacts radially positioned to have contacting surfaces on an inside surface of the annular housing and in the recess, each contacting surface at a corresponding one of the plurality of openings; and a connect-detect contact in the recess, a cam around the connect-detect contact, the cam comprising keying features formed as side notches.

17. The connector insert of claim 16 further comprising a lead frame, wherein each of the plurality of contacts terminates in the lead frame.

18. The connector insert of claim 17 further comprising an interposer supporting the lead frame.

19. The connector insert of claim 18 further comprising a ferro-magnetic ring to be attracted to a magnet in a corresponding connector receptacle.

20. The connector insert of claim 16 wherein the cam has a curved front surface to guide alignment features of a connector receptacle into the side notches of the cam when the connector insert is connected to the connector receptacle.

* * * * *